US006858368B2

(12) United States Patent
Azuma et al.

(10) Patent No.: US 6,858,368 B2
(45) Date of Patent: Feb. 22, 2005

(54) ELECTROPHOTOGRAPHIC PHOTORECEPTOR AND IMAGE FORMING DEVICE

(75) Inventors: Jun Azuma, Osaka (JP); Yukimasa Watanabe, Osaka (JP); Ayako Yashima, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 168 days.

(21) Appl. No.: 10/249,102

(22) Filed: Mar. 17, 2003

(65) Prior Publication Data

US 2004/0185357 A1 Sep. 23, 2004

(51) Int. Cl.[7] ..... G03G 13/20

(52) U.S. Cl. ..... 430/124; 430/58.05; 399/159; 399/320; 399/336

(58) Field of Search ..... 430/58.05, 124; 399/159, 320, 336

(56) References Cited

FOREIGN PATENT DOCUMENTS

| | | |
|---|---|---|
| JP | H06-167906 A | 6/1994 |
| JP | H06-236133 A | 8/1994 |

*Primary Examiner*—Mark A. Chapman
(74) *Attorney, Agent, or Firm*—Shinjyu Global IP

(57) ABSTRACT

An image forming device is disclosed which comprises an electrophotographic photoreceptor and a flash fixing means. The photoreceptor has a photoconductive layer formed on top of a support substrate, and the photoconductive layer contains a charge generating agent and a charge transport agent therein. The half maximum wavelength region of the charge transport agent's absorption peak is in a visual region that includes the wavelength region of the flash light when its intensity is 50% or greater of its maximum but does not include the wavelength region of the exposure light. This photoreceptor will not produce electrostatic irregularities even if light from the flash fixing means leaks thereon, and its sensitivity and its ability to be electrostatically charged will not decrease even if repeatedly used.

11 Claims, 6 Drawing Sheets

ELECTROPHOTOGRAPHIC PHOTORECEPTOR AND IMAGE FORMING DEVICE

BACKGROUND OF INVENTION

1. Field of the Invention

This invention generally relates to an electrophotographic photoreceptor suitable for flash fixing. In addition, the present invention relates to an image forming device that employ the same, such as laser printers, electrostatic copying machines, plain paper facsimile devices, and multifunction devices which combine these functions.

2. Background Information

A conventional image forming device electrostatically charges the surface of an electrophotographic photoreceptor, exposes an original document having an image thereon, and forms an electrostatic latent image on the surface of the photoreceptor that corresponds to the image on the original document. After developing the electrostatic latent image with toner, the image forming device transfers the toner formed on the photoreceptor to a recording medium such as paper. The recording medium is then separated from the photoreceptor, and an image is formed thereon by fixing the toner. After the toner is transferred to the recording medium, any remaining electric charge on the photoreceptor is removed, and an electrostatic charge is again placed on the photoreceptor in order to produce another image. One means for fixing the toner image that is employed by this type of image forming device is a flash fixing means which uses a flash lamp.

In the flash fixing means, the toner absorbs the radiant heat or light energy from flash light source, is heated and melted thereby, and then fixed to a recording medium. When this occurs, the absorption of the light energy is limited to the toner only; the recording medium itself absorbs almost no light energy. Thus, if a flash fixing means is employed, there is little damage to the recording medium from the heat used during fixing, because of the small degree to which the temperature of the image forming device is increased due to this heat.

However, in conventional image forming devices, the light that radiates from the flash lamp (the flash light) leaks from the flash fixing means and reaches the photoreceptor. Normally, the flash fixing means and the recording medium do not come into contact with each other, and have a fixed gap formed between each other. This configuration allows a toner image to be fixed on the recording medium by radiating the flash light from a predetermined distance thereabove, and also serves to prevent any unfixed portion of the toner image on the recording medium from becoming smeared. In addition, because fixing is performed after the transfer process, the flash fixing means is disposed downstream of the transfer device in the transport direction, and is disposed comparatively close to the photoreceptor.

Because of this configuration, flash light leakage from the flash fixing means is inevitable, and thus leaked light radiates onto the photoreceptor after the transfer process has been completed. When this occurs, the portion of the photoreceptor on which the leaked light is radiated onto will generate a positive or negative electrical charge by means of the charge generating agent therein, and will neutralize the electrical charge on the surface of the photoreceptor that was placed thereon after the transfer process. In other words, an electrical charge that has a polarity that is the reverse of the electrical charge on the surface of the photoreceptor will neutralize the same, and because of this, an electrical charge with the same polarity will move toward the support substrate of the photoreceptor. When this occurs, the surface electric potential of the photoreceptor will be reduced to a certain extent because a reverse bias electrical potential is placed thereon in the transfer process. When light leaked from the flash fixing means is radiated onto the photoreceptor in this state, the electric potential on the portion of the photoreceptor on which the light was leaked will immediately drop, regardless of whether it is an exposed portion or unexposed portion.

Further, when the leaked light produces an electric charge in the photosensitive layer of the photoreceptor, the electric charge will remain therein because there is no electric charge on the surface of the photoreceptor that will neutralize it. The electric charge in the photosensitive layer will continue to remain there even after the electric charge on the surface of the photoreceptor is removed after the transfer process. A uniform electrostatic charge is placed on the surface of the photoreceptor in the electrostatic charging process. However, the electric charge on the portion of the photoreceptor on which the leaked light has been radiated will be neutralized by the electric charge remaining in the photosensitive layer. Because of this, the surface electric potential of this portion of the photoreceptor after the electrostatic charging process (and before the exposure process) will be lower than other portions thereof. In addition, the portion of the photoreceptor on which the leaked light has been radiated will not be properly developed, and thus images therefrom will be uneven.

Furthermore, when leaked light is repeatedly radiated onto the photoreceptor, the photoreceptor will become increasingly degraded, and its sensitivity and its ability to be electrostatically charged will decrease. In addition, the density of the image formed on the recording medium will decrease, and the image thereon will become blurred. The degradation in the photoreceptor is thought to be primarily due to an increase in the number of molecules of the charge generating agent that have lost their ability to function as photoconductors after repeatedly generating and discharging an electric charge when optically illuminated.

It is thought that this problem can be prevented from occurring by controlling the amount of light that leaks from the flash fixing means. However, this is difficult from a structural point of view because the area around the flash fixing means cannot be sealed off. On the other hand, reducing the amount of flash light has also been considered. This will result in a reduction in the amount of leaked light, but the fixity of the toner image will worsen. Thus, controlling the amount of light that leaks from the flash fixing means is in actuality quite difficult.

In addition, Japanese Published Patent Application Nos. H06-167906 and H06-236133 disclose using leaked light to actively remove the electric charge from the photoreceptor. In these methods, the transportation of the recording medium to the fixing means must be timed, and the leaked light must be radiated onto the entire electrostatic latent image on the photoreceptor. Because of this, not only is the placement of the fixing means and photoreceptor limited to certain positions, but the photoreceptor can only be one which forms one image per one or less rotation thereof (e.g., a drum shaped photoreceptor which has a large diameter and thus rotates less), thereby making it difficult to reduce the size of the image forming device. In order to use a photoreceptor that requires more than one rotation thereof to form one image, the flash lamp must be illuminated both during and after the fixing process, and thus will increase the cost of operating the image forming device.

SUMMARY OF INVENTION

It is an object of the present invention to eliminate the aforementioned problems, and provide an electrophotographic photoreceptor and an image forming device employing the same that does not generate electrostatic irregularities even if exposed to light leaked from the flash fixing means, and in which the sensitivity of the photoreceptor and its ability to be electrostatically charged do not decrease even with repeated use.

In order to achieve the aforementioned object, the present inventors have identified a method of effectively controlling the degradation of the photoreceptor due to leaked light by limiting the spectral characteristics of the charge transport agent contained in the photosensitive layer of the electrophotographic photoreceptor to an optimal range.

An electrophotographic photoreceptor according to a first aspect of the present invention is employed in an image forming device having a flash fixing means that fixes a toner image to a recording medium by generating a flash light and exposing the toner image thereto. The photoreceptor is comprised of a photosensitive layer, and the photosensitive layer is provided on top of a support substrate. The photosensitive layer includes a photoconductive layer that has a charge generating agent and a charge transport agent therein. When the intensity of the flash light is 50% or greater of maximum, the half maximum wavelength region of the absorption peak of the charge transport agent is in a visual region which does not include the wavelength region of the exposure light.

In this electrophotographic photoreceptor, light leaked from the flash fixing means is absorbed by the charge transport agent, and thus the leaked light can be prevented from radiating onto the charge generating agent, and both unneeded charge generation from the charge-generating agent and the optical degradation of the charge generating agent can be controlled.

The electrophotographic photoreceptor according to this aspect of the present invention may also include the following features:

1. If the photoconductive layer does not contain a charge generating agent, then the photoconductive layer has an absorbance wavelength that is in a visual region that includes the wavelength regions of the flash light when at 50% or greater of maximum intensity but does not include the wavelength region of the exposure light, and has a light absorbance of 1 unit or greater per one micron of thickness thereof at that absorbance wavelength.

Here, the charge transport agent can absorb 90% or more of the light leaked from the flash fixing means per one micron of the photoconductive layer, even if it is near the surface thereof, because the density of the charge transport agent therein is set at a sufficient level. Thus, the leaked light can be effectively prevented from radiating onto the charge generating agent contained in the same layer as the charge transport agent.

2. The photosensitive layer is a single layer type.

Here, the leaked light is efficiently absorbed by the charge transport agent, because the charge transport agent is present in the uppermost portion of the photosensitive layer and has an absorbance wavelength that is in a visual region that includes the wavelength regions of the flash light, but does not include the wavelength region of the exposure light.

3. If the photoconductive layer does not contain a charge generating agent, then the photoconductive layer will absorb 0.01 units or less of light per one micron thereof in the wavelength region of the exposure light.

Here, the photoreceptor can not only control the leaked light that the charge generating agent is exposed to, but can make the light from the exposure light act on the charge generating agent more efficiently.

In the electrophotographic photoreceptor according to this aspect of the present invention, the charge transport agent in the photosensitive layer can control the leaked light acting upon the charge generating agent, and thus can both prevent the charge generating agent from generating unnecessary charges and prevent the optical deterioration thereof, by absorbing light from the flash fixing means having certain wavelengths.

An electrophotographic photoreceptor according to another aspect of the present invention is employed in an image forming device having a flash fixing means that fixes a toner image to a recording medium by generating a flash light and exposing the toner image thereto. The photoreceptor is comprised of a photosensitive layer, and the photosensitive layer is provided on top of a support substrate. The photosensitive layer includes a charge generating layer and an electron transport layer. The charge generating layer contains a charge generating agent. The charge transport layer contains a charge transport agent, and is provided on top of the charge generating layer. When the intensity of the flash light is 50% or greater of maximum, the half maximum wavelength region of the absorption peak of the charge transport agent is in a visual region which does not include the wavelength region of the exposure light.

In this electrophotographic photoreceptor, light leaked from the flash fixing means is absorbed by the charge transport agent, and thus the leaked light can be prevented from reaching the charge generating layer, and both unneeded charge generation from the charge generating agent and the optical degradation of the charge generating agent can be controlled.

The electrophotographic photoreceptor according to this aspect of the present invention may also include the following features:

1. The charge transport layer has an absorbance wavelength that is in a visual region that includes the wavelength regions of the flash light when at 50% or greater of its maximum intensity but does not include the wavelength region of the exposure light, and has a light absorbance of 1 unit or greater at that absorbance wavelength.

Here, the leaked light can be effectively prevented from radiating onto the charge generating agent contained in the charge generating layer, because less than 10% of the leaked light passes through the charge transport layer due to the aforementioned absorbance wavelength. Note that in the present invention, the light absorbance of charge transport layer is the absorbance as measured through the thickness thereof.

2. The charge transport layer will absorb 0.1 units or less of light in the wavelength region of the exposure light.

Here, the charge transport layer can absorb the leaked light and the light from the exposure light can pass therethrough. Thus, the photoreceptor can not only control the leaked light that the charge generating layer is exposed to, but can make the light from the exposure light act on the charge generating agent more efficiently.

The charge transport agent is contained in the photosensitive layer, and is a material that serves to transport a charge produced by the charge generating agent to the surface of the photoreceptor or to the support substrate. Thus, in the two electrophotographic photoreceptors described above, the structure of the materials in the photoreceptor will not dramatically change, the ability of the photoreceptor to transport a charge will be maintained, and the optical degradation of the charge generating agent by the leaked light will be controlled, even if the image forming device employs a flash fixing system therein.

Note that in the present invention, the half maximum (i.e., full-width half-maximum) wavelength region of the absorbance peak is the wavelength region between the points on the absorption curve which are half the maximum value thereof.

An image forming device of the present invention is comprised of one of the aforementioned electrophotographic photoreceptors, a drive means, a flash fixing means, and an image forming unit. The drive means drives the photoreceptor in a fixed direction. The flash fixing means serves to fix a toner image to a recording medium by exposing it to flash light generated by an exposure light. The image forming unit is disposed along the direction in which the photoreceptor is driven, and has an exposure light means that conducts exposure.

In the image forming device of the present invention, a charge removal means and a cleaning means may be provided downstream from the transfer means in the drive direction.

The wavelength regions of the flash light generated in the image forming device of the present invention are the 400 nm to 586 nm region, the 817 nm to 844 nm region, and the 882 to 900 nm region when the flash light is at 50% or greater of its maximum intensity. The wavelength region of the exposure light generated by the exposure means may be in the 760 nm to 800 nm region. The charge generating agent may be a metal-containing or a metal-free phthalocyanine compound. In addition, the charge transport agent can be selected from the group consisting of the following general formulas (1) to (6):

(1)

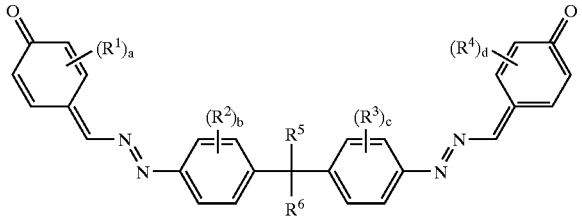

wherein $R^1$ to $R^6$ are independently selected from the group consisting of hydrogen, halogen, alkyl, halogen substituted alkyl, alkoxy, halogen substituted alkoxy, aryl, nitro and cyano, and a to d are integers from 1 to 4;

(2)

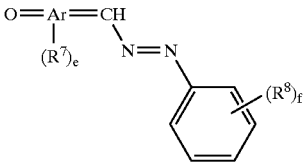

wherein Ar is an aromatic hydrocarbon or a fused polycyclic hydrocarbon, $R^7$ to $R^8$ are independently selected from the group consisting of hydrogen, halogen, alkyl, halogen substituted alkyl, alkoxy, halogen substituted alkoxy, aryl, nitro and cyano, e is an integer from 1 to 4, and f is an integer from 1 to 5;

(3)

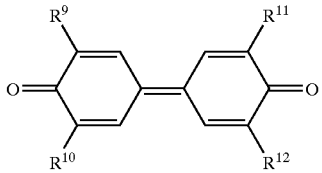

wherein $R^9$ to $R^{12}$ are independently selected from the group consisting of hydrogen, halogen, alkyl, halogen substituted alkyl, alkoxy, halogen substituted alkoxy, aryl, nitro and cyano;

(4)

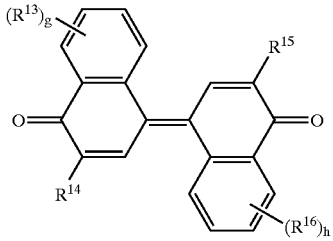

wherein $R^{13}$ to $R^{16}$ are independently selected from the group consisting of hydrogen, halogen, alkyl, halogen substituted alkyl, alkoxy, halogen substituted alkoxy, aryl, nitro and cyano, and g and h are integers from 1 to 4;

(5)

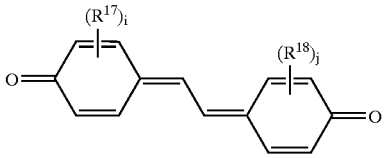

wherein $R^{17}$ to $R^{18}$ are independently selected from the group consisting of hydrogen, halogen, alkyl, halogen substituted alkyl, alkoxy, halogen substituted alkoxy, aryl, nitro and cyano, and i and j are integers from 1 to 4; and (6)

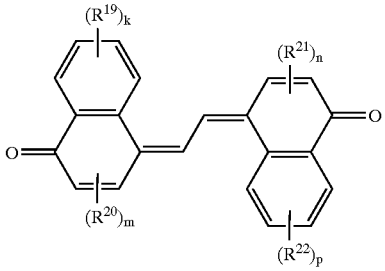

wherein $R^{19}$ to $R^{22}$ are independently selected from the group consisting of hydrogen, halogen, alkyl, halogen substituted alkyl, alkoxy, halogen substituted alkoxy, aryl, nitro and cyano, k and p are integers from 1 to 4, and m and n are integers from 1 to 2.

Here, the combination of the wavelengths of the exposure light and the charge transport agent allows one to both control the degradation of the charge generating agent due to leaked light and efficiently radiate the exposure light onto the charge generating agent.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF DRAWINGS

Referring now to the attached drawing which forms a part of this original disclosure.

DETAILED DESCRIPTION

Figure 1:
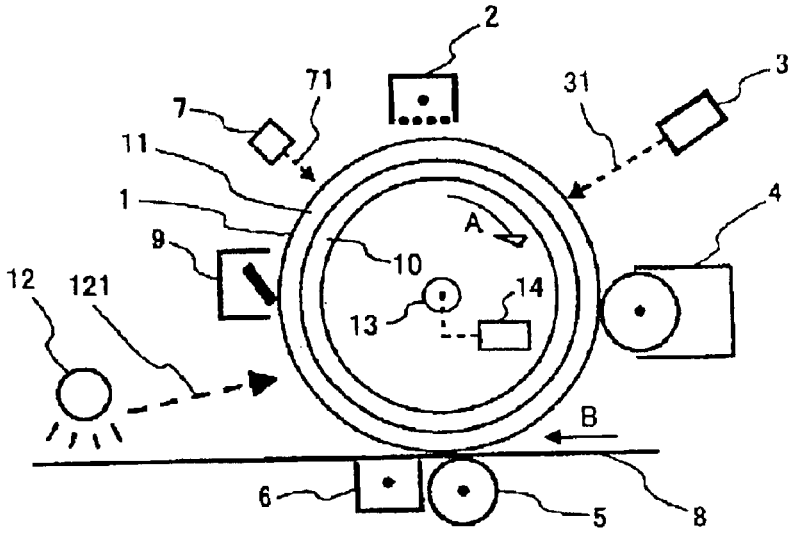
FIG. 1 shows the structure of an image forming device of the present invention.

1. First Embodiment a. Electrophotographic Photoreceptor (i) Photosensitive Layer The electrophotographic photoreceptor according to a first embodiment of the present invention is comprised of a support substrate, and a photosensitive layer that contains a charge generating agent and a charge transport agent (a hole transport agent and/or an electron transport agent) and which is provided on top of the support substrate.

The photosensitive layer will normally be either a single layer type or a laminated type, and either one can be used in the present invention.

The single layer type of photosensitive layer is comprised of a single photoconductive layer that contains a charge generating agent and a charge transport agent. Here, the single layer type of photosensitive layer is formed by applying a coating liquid on top of the support substrate by means of an application means, and then drying this coating liquid thereof. The coating liquid comprises these compounds (the charge generating agent and the charge transport agent) dissolved or dispersed in a binding resin and a suitable organic solvent. The charge transport agent is a compound in which the half maximum wavelength region of its absorption peak is in a visible region that includes the wavelength regions of the flash light but does not include the wavelength region of the exposure light. Either a hole transport agent or an electron transport agent can be used as the charge transport agent. The hole transport agent or the electron transport agent can also be used together as the charge transport agent.

This single layer type of photosensitive layer can be easily formed, has excellent productivity, and can have either a positive or negative electrostatic charge.

On the other hand, a laminated type of photosensitive layer is formed by first placing the aforementioned single layer type of photosensitive layer on top of the support substrate to form a photoconductive layer, and then forming a charge transport layer containing a charge transport agent on top of the photoconductive layer by using a CVD vapor growth method or by using an application means. The order in which the photoconductive layer and the charge transport layer are formed may be reversed. In addition, a charge generating layer that contains a charge generating agent may be substituted for the charge transport layer. Furthermore, a plurality of photoconductive layers may be formed and combined together.

The sequence in which each of the aforementioned layers in the laminated type of photosensitive layer are formed can be modified in accordance with the type of charge transport agent (hole transport agent and/or electron transport agent) used in the photosensitive layer. However, in the present embodiment, the charge transport agent that is used in the photoconductive layer is a compound which has an absorption wavelength in a visible region that includes the wavelength regions of the flash light but does not include the wavelength region of the exposure light.

Specific examples of laminated photosensitive layers include, but are not limited to:

(a) a negative electrostatic type of laminated photosensitive layer in which a photoconductive layer containing a charge generating agent and a charge transport agent (a hole transport agent and/or an electron transport agent) having the aforementioned spectral characteristics is formed on top of a conductive substrate, and a charge transport layer containing a hole transport agent is laminated on top of the photoconductive layer;

(b) a negative electrostatic type of laminated photosensitive layer in which a charge transport layer containing an electron transport agent is formed on top of a conductive substrate, and a photoconductive layer containing a charge transport agent (a hole transport agent and/or an electron transport agent) having the aforementioned spectral characteristics is laminated on top of the charge transport layer;

(c) a positive electrostatic type of laminated photosensitive layer in which a photoconductive layer containing a charge generating agent and a charge transport agent (a hole transport agent and/or an electron transport agent) having the aforementioned spectral characteristics is formed on top of a conductive substrate, and a charge transport layer containing an electron transport agent is laminated on top of the photoconductive layer;

(d) a positive electrostatic type of laminated photosensitive layer in which a charge transport layer containing a hole transport agent is formed on top of a conductive substrate, and a photoconductive layer containing a charge generating agent and a charge transport agent (a hole transport agent and/or an electron transport agent) having the aforementioned spectral characteristics is laminated on top of the charge transport layer; and (e) a positive/negative type of laminated photosensitive layer which comprises two or more photoconductive layers of the single layer type photosensitive layer described above that have been laminated to each other.

A charge generating layer, a charge transport layer, and/or a photoconductive layer can be added to layers (a) to (e) according to need. However, a charge generating layer cannot be provided on top of a photoconductive layer that contains a charge transport agent having the aforementioned spectral characteristics. Neither the charge transport agent in the charge transport layer provided on top of the photoconductive layer, nor the charge transport agent in another photoconductive layer provided below the aforementioned photoconductive layer, are required to have the aforementioned spectral characteristics.

Layer (e) not only has the same advantages as the aforementioned single layer type of photosensitive layer, but is superior because the electrical characteristics of the photoreceptor can be precisely adjusted by changing the composition between the plurality of photoconductive layers.

Among layers (a) to (d), the negative electrostatic type of laminated photosensitive layers (a) and (b) are preferred because their electrical characteristics, such as the degree of photosensitivity, the residual electric potential, and the like, are better than those of the positive electrostatic type.

In addition, because the charge generating layer is much thinner than the charge transport layer, in order to protect the charge generating layer it is preferred that it be formed on top of the conductive substrate, and the charge transport layer be formed on top of the charge generating layer.

Furthermore, if the photoconductive layer does not contain a charge generating agent, it is preferred that (a) it have an absorbance wavelength that is in a visible region which includes the wavelength regions of the flash light when at 50% or greater of its maximum intensity but does not include the wavelength region of the exposure light, and (b) its light absorbance per one micron of thickness thereof is one unit or greater. In addition, if the photoconductive layer does not contain a charge generating agent, it is also preferred that its absorbance per one micron of thickness in the wavelength region of the exposure light be 0.01 unit or less.

(ii) Charge Transport Agent

The charge transport agent used in the electrophotographic photoreceptor of the present invention is a compound in which the half maximum wavelength region of its absorption peak is in a visible region that includes the wavelength regions of the flash light when at 50% or greater of its maximum intensity but does not include the wavelength region of the exposure light. In addition, this compound has a hole transport and/or electron transport ability. The charge transport agent can absorb light leaked from the flash fixing means, and thus control the amount of leaked light that radiates onto the charge generating agent.

However, it is preferred that the charge transport agent absorb little light in the wavelength region of the exposure light, and also preferred that it does not hinder the exposure light radiated onto the charge generating agent.

Specific examples of the aforementioned charge transport agent include, but are not limited to, hole transport agents having the aforementioned spectral characteristics such as benzidine compounds, phenylenediamine compounds, naphthylenediamine compounds, phenanthrenediamine compounds, oxidiazole compounds (e.g., 2,5-di (4-methylaminophenyl)-1,3,4-oxadiazole), styryl compounds (e.g., 9-(4-diethylaminostyryl) anthracene), carbazole compounds (e.g., poly-N-vinyl carbozole, pyrazoline compounds (e.g., 1-phenyl-3-(p-dimethylaminophenyl) pyrazoline), hydrazone compounds (e.g., diethylaminobenzaldehyde diphenylhydrazone), triphenylamine compounds, indole compounds, oxozole compounds, isoxazole compounds, thiozole compounds, thiadiazole compounds, imidazole compounds, pyrazole compounds, triazol compounds, butadiene compounds, pyrene-hydrazone compounds, acrolein compounds, carbazole-hydrazone compounds, quinoline-hydrazone compounds, stilbene compounds, stilbene-hydrazone compounds, diphenylenediamine compounds, and organic polysilane compounds, and electron transport agents having the aforementioned spectral characteristics such as benzoquinone compounds, naphthoquinone compounds, diphenoquinone compounds (e.g., 2,6-dimethyl-2',6'-t-butylbenzoquinone), ketone compounds, malononitrile, thiopyran compounds, tetracyanoethylene, 2,4,8-trinitrothioxanthone, fluorenone (e.g., 2,4,7-trinitro-9-fluorenone), dinitrobenzene, dinitroanthracene, dinitroacridine, nitroanthracene, succinic anhydride, maleic anhydride, dibromomaleate, 2,4,7-trinitrofluorenoneimine compounds, ethylated nitrofluorenoneimine compounds, toryptanthorinecompounds, toryptanthorineimine compounds, azafluorenone compounds, dinitropyridoquinazoline compounds, thiozanthene compounds, 2-phenyl-1,4-naphthoquinone compounds, 5,12-naphthacenequinone compounds, α-cyanostilbene compounds, 4'-nitrostilbene compounds, and benzoquinone compounds, as well as the salts of the anions and cations thereof.

These charge transport agents may be used separately, or may be used in combinations of two or more. If two or more charge transport agents are used in combination, it is effective to combine those that can absorb light in mutually different wavelength regions because they can absorb a broader spectrum of leaked light.

Note that a charge transport agent that does not have the aforementioned spectral characteristics may be used in order to adjust the electrical characteristics of the photoreceptor.

(iii) Charge Generating Agent

Examples of the charge generating agent used in the single layer or laminated photosensitive layer include, but are not limited to, inorganic photoconducting powders such as amorphous inorganic materials (e.g., a-silicon, a-carbon, etc.), and a variety of pigments well known in the prior art, such as metal-free phthalocyanine, phthalocyanine pigments which includes a variety of crystal systems of phthalocyanine that are coordinated by metals (e.g., titanium, copper, aluminum, iron, cobalt, nickel, indium, gallium, tin, zinc, vanadium, etc.) or metal oxide compounds (oxides of the aforementioned metals such as titanium oxide), azo pigments, bisazo pigments, perylene pigments, anthanthrone pigments, indigo pigments, triphenylmethane pigments, indanthrene pigments, toluidine pigments, pyrazoline pigments, quinacrine pigments, and dithioketopyrrolopyrrole pigments.

The charge generating agents may be used individually, or two or more types may be used in combination, in order to make the photosensitive layer sensitive to the wavelength region of the exposure light.

(iv) Binding Resin

Examples of binding resins include, but are not limited to, thermoplastic resins such as styrene polymers, styrene-butadiene copolymers, styrene-acrylonitrile copolymer, styrene-maleate copolymers, acrylic polymers, styrene-acrylic copolymers, polyethylene, ethylene-vinyl acetate copolymers, chlorinated polyethylene, polyvinyl chloride, polypropylene, vinyl chloride-vinyl acetate copolymers, polyester, alkyd resins, polyamide, polyurethane, polycarbonate, polyalylate, polysulfone, diallyl phthalate resins, ketone resins, polyvinyl butyral resins, and polyether resins, thermosetting resins having the ability to cross-link, such as silicone resins, epoxy resins, phenol resins, urea resins, and melamine resins, and photocurable resins such as epoxy acrylate and urethane acrylate. Each of these resins not only may be used individually, but two or more types may also be used in combination.

In addition, if, from among the hole transport agents illustrated above, a high polymer such as poly-N-vinyl carbozole or organic polysilane compounds is used, that compound can also function as a binding agent, and thus the normal binding agents illustrated above can be omitted.

A variety of other components may be added to the photosensitive layer, including for example fluorene compounds, ultraviolet stabilizers, plasticizers, surface active agents, leveling agents, and the like. In addition, a sensitizing agent such as terphenyl, halonaphthoquinone, or acenaphthylene may also be added to the photosensitive layer in order improve the sensitivity of the photoreceptor.

(v) Support Substrate

The support substrate on which the photosensitive layer is formed can be formed from a variety of conductive materials, e.g., metals such as iron, aluminum, copper, tin, platinum, silver, vanadium, molybdenum, chromium, cadmium, titanium, nickel, palladium, indium, stainless steel, brass, and the like, plastic materials on which one or more of these metals have been vapor deposited or laminated thereon, or glass and the like that has been coated with materials such as aluminum iodide, tin oxide, indium oxide, and the like.

The support substrate may have any shape that conforms to the structure of the image forming device in which it is used, such as a sheet shape, belt shape, drum shape, or the like. The entire substrate can be conductive, or only the surface thereof can be conductive. In addition, the support substrate preferably has sufficient mechanical strength when it is used.

(vi) Production of the Photosensitive Layer

When a photoconductive layer is to be formed, it is preferred that 0.1 to 50 parts by weight, and more preferably 0.5 to 30 parts by weight, of a charge generating agent be added to each 100 parts by weight of the binding resin. In addition, it is preferred that 5 to 500 parts by weight, and more preferably 25 to 200 parts by weight, of a hole transport agent be added to each 100 parts by weight of the binding resin. Furthermore, it is preferred that 5 to 100 parts by weight, and more preferably 10 to 80 parts by weight, of an electron transport agent be added to each 100 parts by weight of the binding resin.

Here, when a hole transport agent having the aforementioned spectral characteristics is used, it can be used in conjunction with another hole transport agent. In this situation, the percentage of hole transport agent to be used is the total for both hole transport agents. In addition, it is preferable that only a small amount of the other hole transport agent be added so that it does not interfere with the effects of the hole transport agent having the aforementioned spectral characteristics. More specifically, it is preferable that 30 parts or less by weight of the other hole transport agent be added to each 100 parts by weight of the hole transport agent having the aforementioned spectral characteristics. Note that these rules also apply to the electron transport agent.

In addition, the total weight of the hole transport agent and the electron transport agent used is preferably 20 to 500 parts by weight, and more preferably 30 to 200 parts by weight, for each 100 parts by weight of the binding resin.

Here, the number of parts by weight of the charge transport agent (hole transport agent, electron transport agent) can be set in a range which achieves the aforementioned degree of photosensitivity required when the charge generating agent is omitted from the photoconductive layer.

The photoconductive layer is preferably 5 to 100 microns in thickness, and more preferably 10 to 50 microns in thickness.

If a charge generating layer or a charge transport layer is included, each layer is preferably formed as noted below.

As noted above, if the charge generating layer is formed with a separate charge generating agent, and the charge generating agent is dispersed in a binding resin, it is preferred in the latter case that 5 to 1000 parts by weight, and more preferably 30 to 500 parts by weight, of the charge generating agent be added to each 100 parts by weight of the binding resin.

If the charge transport layer is to include a hole transport agent, it is preferred that 10 to 500 parts by weight, and more preferably 25 to 200 parts by weight, thereof be added to each 100 parts by weight of the binding resin. In addition, if the charge transport layer is to contain an electron transport agent, it is preferred that 0.1 to 250 parts by weight, and more preferably 0.5 to 150 parts by weight, thereof be added to each 100 parts by weight of the binding resin.

The charge generating layer is preferably 0.01 to 5 microns in thickness, and more preferably 0.1 to 3 microns in thickness, and the charge transport layer is preferably 2 to 100 microns in thickness, and more preferably 5 to 50 microns in thickness.

An intermediate layer, barrier layer, or protective layer may be formed in between either the photosensitive layer and the conductive support substrate, or between each layer that makes up a laminated photosensitive layer, so long as these layers do not interfere with the characteristics of the photoreceptor. The intermediate layer, barrier layer, or protective layer can contain a charge transport agent and used as a charge transport layer, and thus have a dual function.

If each layer that makes up the photoreceptor is to be formed by the application method, a charge generating agent, a charge transport agent, and a binding resin noted above will be added to one of the organic solvents noted above such as tetrahydrofuran or the like. These ingredients will then be dispersion mixed with a method known in the prior art, such as with a roll mill, a ball mill, an Attria mixer, a paint shaker, or an ultrasonic distributor, and an application liquid will be prepared thereby. This application liquid is applied and dried to the support substrate by using means known in the prior art.

Examples of organic solvents that can be used to produce the application liquid include, but are not limited to, alcohols such as methanol, ethanol, isopropanol, and butanol, aliphatic hydrocarbons such as n-hexane, octane, and cyclohexane, aromatic hydrocarbons such as benzene, toluene, and xylene, halogenated hydrocarbons such as dichloromethane, dichloroethane, carbon tetrachloride, and chlorobenzene, ethers such as dimethyl ether, diethyl ether, tetrahydrofuran, 1,4-dioxane, ethylene glycol dimethyl ether, and diethylene glycol dimethyl ether, ketones such as acetone, methyl ethyl ketone, and cyclohexanone, esters such as ethyl acetate and methyl acetate, dimethylformaldehyde, dimethylformamide, and dimethylsulfoxide, and can be used individually or in combinations of two or more.

A surface active agent and/or a leveling agent can be added to the application liquid in order to make the charge transport agent and/or the charge generating more dispersible and to make the surface of the photosensitive layer more smooth.

b. Image Forming Device

An image forming device in which an embodiment of the present invention is used is schematically shown in FIG. 1.

This image forming device is comprised of an electrophotographic photoreceptor 1. The electrophotographic photoreceptor 1 includes a support substrate 10 and a photosensitive layer 11 formed on top of the support substrate 10. A central axis 13 of the electrophotographic photoreceptor 1 is connected thereto via a driver 14 and gears and pulleys (not shown in the figure), and rotates at a constant speed in one direction (the direction of the arrow A).

An electrostatic device 2, an exposure device 3, a developing device 4, and a transfer device 5 are provided in this sequence around the perimeter of the photoreceptor 1 in the drive direction (i.e., in the direction of rotation). In addition, as shown in FIG. 1, a separation means 6, a charge removal means 7, and a cleaning means 9 can also be provided according to need.

The image forming device of the present invention further comprises a flash fixing means 12 which fixes a toner image transferred to a transfer medium 8 thereto.

When an image is formed by means of this image forming device, the surface of the photoreceptor 1 will be uniformly charged by means of the electrostatic device 2. Next, the surface of the photoreceptor 1 will be exposed along an exposure axis 31 by means of the exposure device 3, and an electrostatic latent image that corresponds to an original image will be formed on the surface of the photoreceptor 1. Afterward, the portion that corresponds to the electrostatic latent image will be developed with toner by the developing device 4. Then, the toner image on the surface of the photoreceptor 1 will be transferred, by means of the transfer device 5, onto the transfer medium 8 that is transported thereto (in the direction of the arrow B). After transfer, the transfer medium 8 will be separated from the photoreceptor 1 by the separation device 6, the transfer medium 8 will be transported to the flash fixing means 12 and then the toner will be fixed by means of the flash light therefrom.

Here, as noted above, a portion of the flash light is radiated onto the photoreceptor 1 as leaked light 121.

After transfer, the toner remaining on the photoreceptor 1 that has not been transferred to the transfer medium 8 will be removed by means of the cleaning means 9. After this, any electric charge remaining on the surface of the photoreceptor 1 will be removed by the charge removal means 7, and will again be electrostatically charged by the electrostatic device 2.

The exposure device 3 will generally use a wavelength of laser light that the photoreceptor 1 is sensitive to. Specifically, when phthalocyanine pigment is used as the charge generating agent, a red semiconductor laser having a wavelength of 600 to 800 nm can be used. Other charge generating agents and their associated wavelengths are shown below in Table 1.

TABLE 1

| Charge generating agent | Wavelength of exposure light (nm) |
|---|---|
| a-silicon | 700–800 |
| a-carbon | 700–800 |
| Phthalocyanine pigments | 600–800 |
| Azo pigments | 550–700 |
| Bisazo pigments | 600–800 |
| Perylene pigments | 450–600 |
| Anthanthrone pigments | 500–600 |
| Triphenylmethane pigments | 550–650 |

In particular, because the molecules of the charge generating agent have chromophore groups (e.g., >C═C<, >C═O, —N═N—, —N═O—, and the like) that are sensitive to specific wavelengths, a light source having wavelengths that express maximum sensitivity therefrom may be used. The light sources that are preferably used are semiconductor lasers and LEDs.

Note that if the image forming device uses the reverse development method, the image on the original document will be exposed, and thus the surface electric potential of the photoreceptor 1 will be low on the image portion of the electrostatic latent image, and high on the non-image portion of electrostatic latent image.

The flash fixing means 12 has a flash lamp that is at least as wide as the maximum width of the transfer medium 8 that can be used in the image forming device. Furthermore, a reflector can be provided so that more of the flash light is radiated onto the transfer medium 8. A halogen lamp, xenon lamp, tungsten lamp, metal halide lamp, LED, or the like can be used as the flash lamp.

Figure 2:
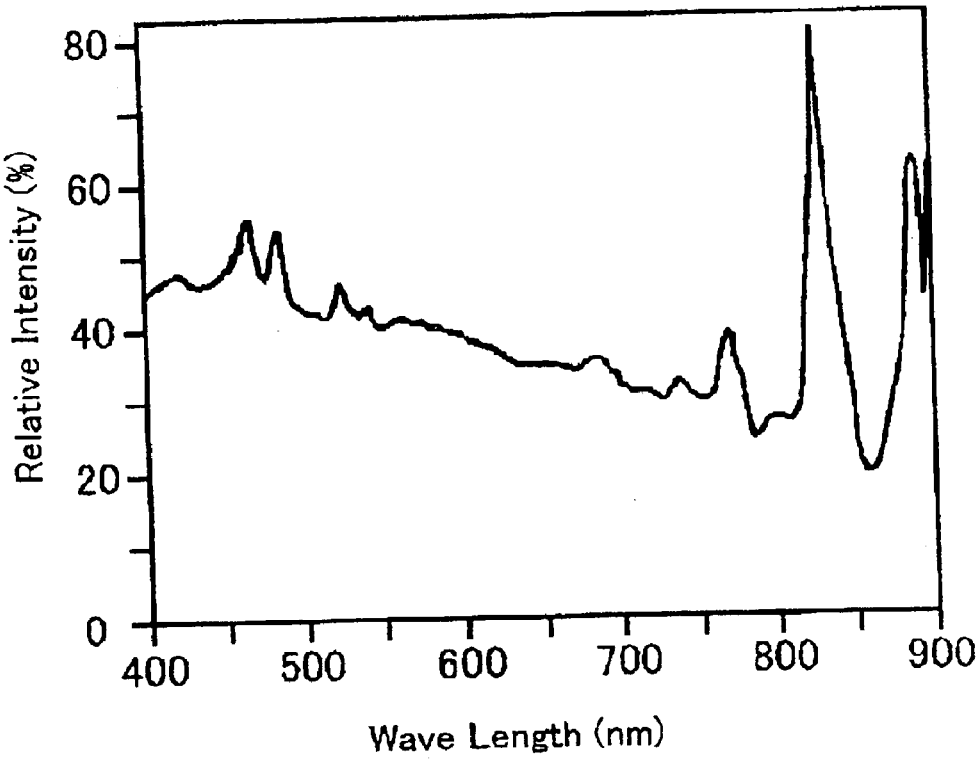
FIG. 2 shows an example of the spectral characteristics of a xenon lamp.
Figure 3:
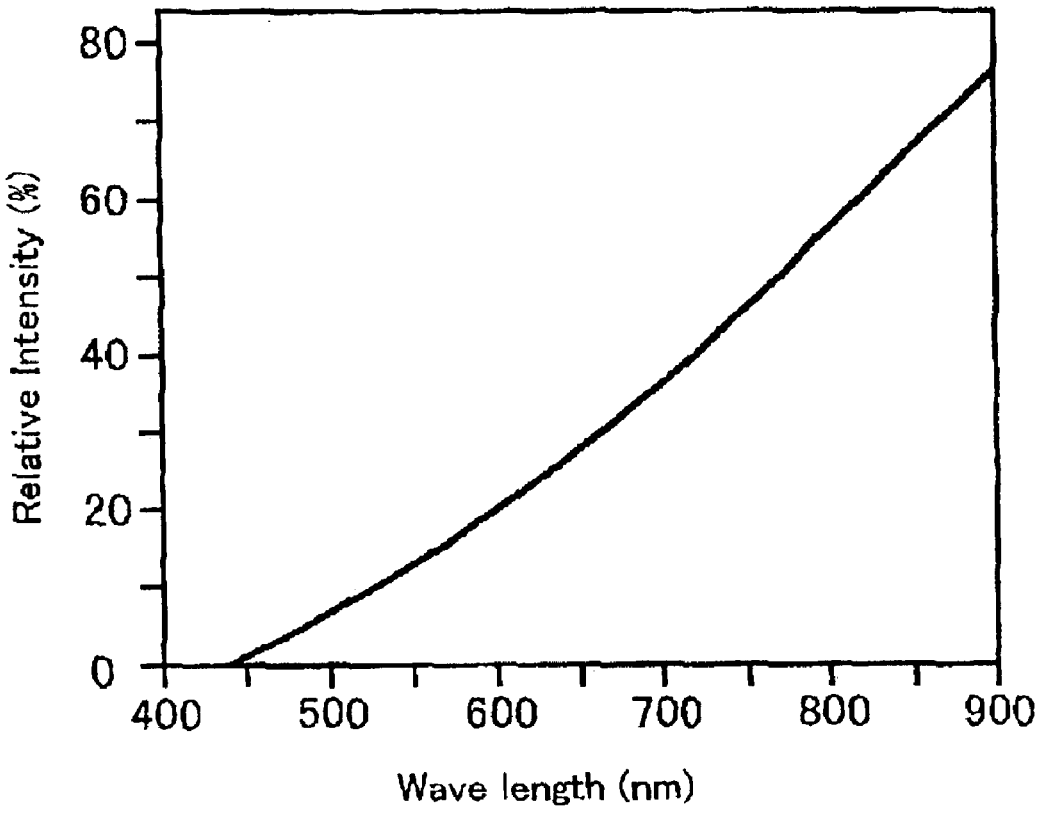
FIG. 3 shows an example of the spectral characteristics of a halogen lamp.
Figure 4:
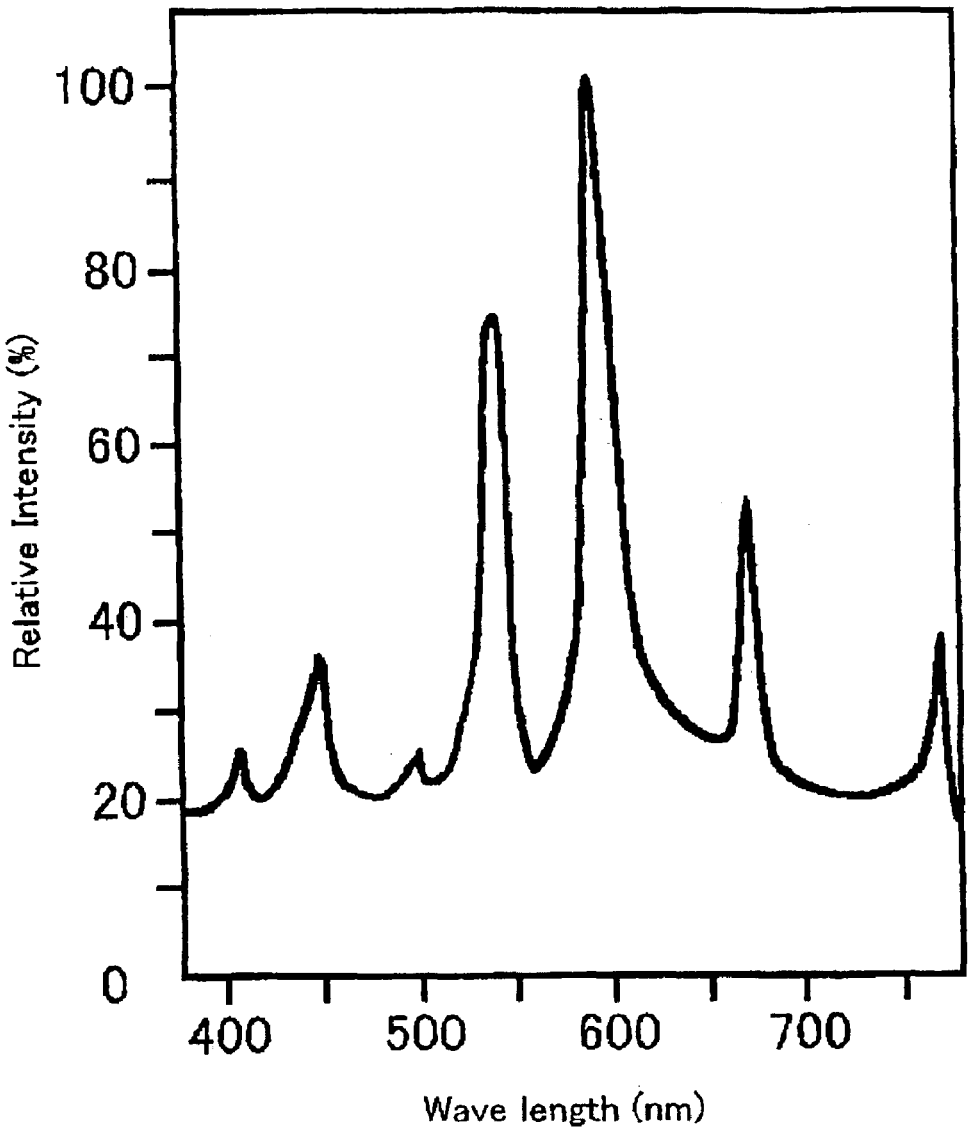
FIG. 4 shows an example of the spectral characteristics of a metal halogen lamp.

Here, the spectral characteristics of each type of flash lamp are different. FIGS. 2, 3 and 4 respectively show the visual region spectral characteristics of a xenon lamp, halogen lamp, and a metal halide lamp used in the present embodiment. Although there are a few differences in the spectral characteristics of these light sources due to discrepancies in their color temperatures, a summary of them is provided below.

As shown in FIG. 2, the xenon lamp has a somewhat high relative intensity across the entire region of visible light, and has wavelengths that peak at 450–500 nm, 750–800 nm, and at 800 nm and beyond.

As shown in FIG. 3, the relative intensity of the halogen lamp increases from 450 nm and beyond.

As shown in FIG. 4, the metal halide lamp displays a certain degree of relative intensity across the entire region of visible light, but has strong peaks at 440, 540, 590, 670, and 760 nm.

The visual wavelengths of the exposure light and the flash light need to be considered in order to determine the spectral characteristics of the photoreceptor 1 used in the image forming device of the present embodiment. In other words, as noted above, the charge transport agent in the photosensitive layer needs to have the half maximum wavelength region of its absorption peak in a visual region which includes the wavelength regions of the flash light but does not include the wavelength region of the exposure light.

For example, in situations in which red laser light at a wavelength of 760 nm to 800 nm is used as the exposure light, and a xenon lamp is used as the flash lamp, the light leaked from the flash lamp can be effectively absorbed when a charge transport agent having an absorption wavelength in a particular visual region is used.

Charge transport agents that meet this criteria are quinone compounds and ketone compounds having the aforementioned general formulas (1) to (6). In addition, compounds having an enlarged TT electron conjugated system, such as general formula (4), general formula (6), and the general formulas (2-33) to (2-38) noted below, are particularly effective even when the photosensitive layer contains only small amounts thereof, because they are able to absorb light having comparatively long wavelengths.

In general formula (2), Ar is an aromatic hydrocarbon or a fused polycyclic hydrocarbon, i.e., those having a molecular frame composed of 6 to 14 carbons such as benzene, pentalene, indene, azulene, naphthalene, heptalene, biphenylene, indacene, acetylnaphthalene, fluorene, phenalene, phenanthrene, and anthracene. From amongst these, naphthalene and anthracene are preferred because their Tr electron conjugated systems extends two dimensionally and because they have an excellent degree of compatibility with resins.

In addition, some specific examples of $R^1$ to $R^{22}$ shown in general formulas (1) to (6) are as follows:

Halogen atoms: fluorine, chlorine, bromine, and iodine;

Alkyl groups: alkyl groups having 1 to 6 carbons such as methyl, ethyl, n-propyl, isopropyl, n-butyl, isobutyl, s-butyl, t-butyl, pentyl, isopentyl, neopentyl, and hexyl groups (preferably alkyl groups having 1 to 4 carbons such as methyl, ethyl, n-propyl, isopropyl, n-butyl, isbutyl, s-butyl, and t-butyl groups);

Alkoxy groups: alkoxy groups having 1 to 6 carbons such as methoxy, ethoxy, propoxy, isopropoxy, butoxy, t-butoxy, pentyloxy, and hexyloxy groups; and Aryl groups: aryl groups having 6 to 14 carbons such as phenyl, tolyl, xylyl, byphenylyl, o-terphenyl, naphthyl, anthryl, and phenanthryl groups.

The aryl groups of $R^1$ to $R^{22}$, and the aromatic hydrocarbons and fused polycyclic hydrocarbons denoted by Ar in general formula (2) can have substitution groups therein, such as hydroxyalkyl groups, alkoxyalkyl groups, monoalkylaminoalkyl groups, dialkylaminoalkyl groups, halogen substituted alkyl groups, alkoxycarbonylalkyl groups, carboxyalkyl groups, alkanoyloxyalkyl groups, aminoalkyl groups, halogen atoms, amino groups, hydroxy groups, carboxyl groups, esterified carboxyl groups, and cyano groups, as well as the halogen atoms, alkyl groups, alkoxy groups, aryl groups, aralkyl groups noted above. The sites where these substitution groups are located is not particularly limited.

The following formulas (1-1) to (1-11) are specific examples of compounds of general formula (1):

(1-1)

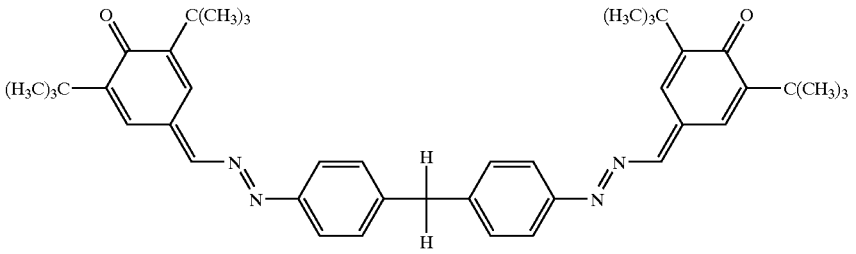

(1-2)

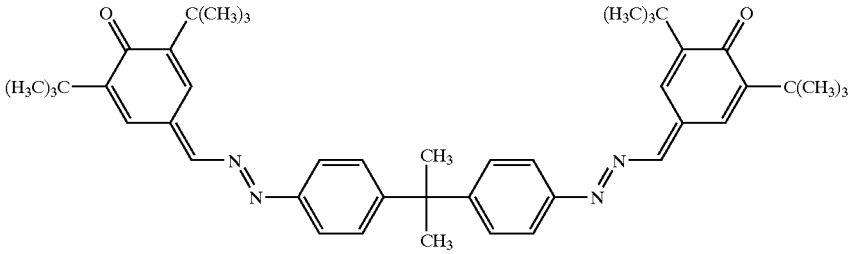

(1-3)

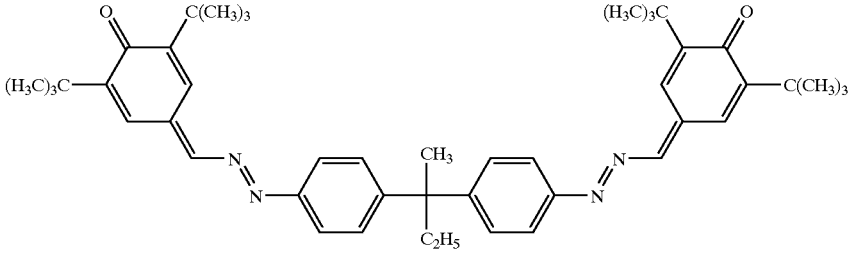

(1-4)

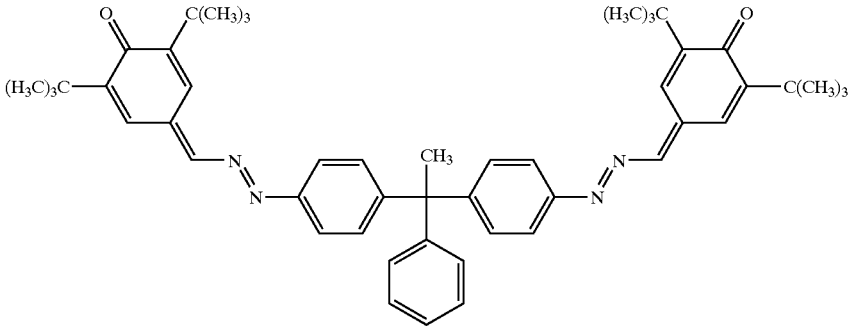

(1-5)

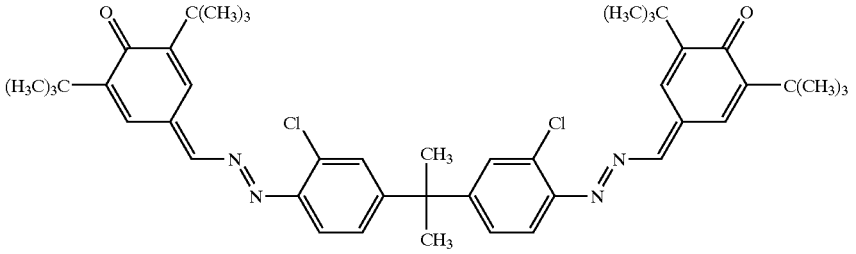

-continued
(1-6)
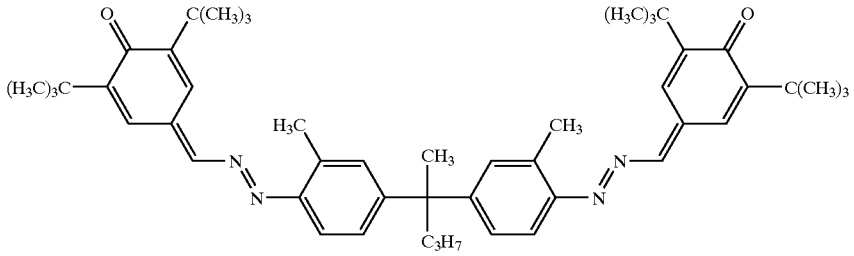
(1-7)
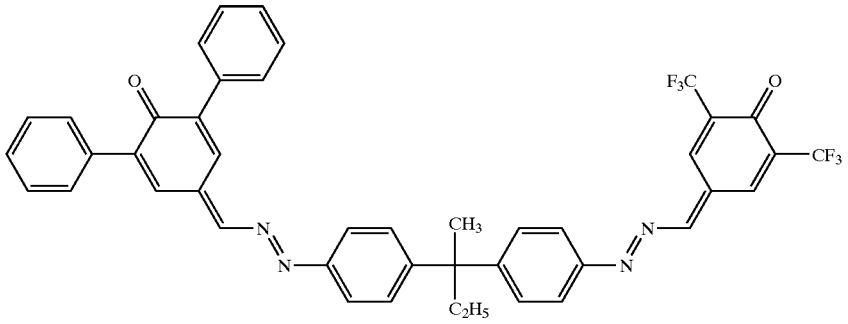
(1-8)
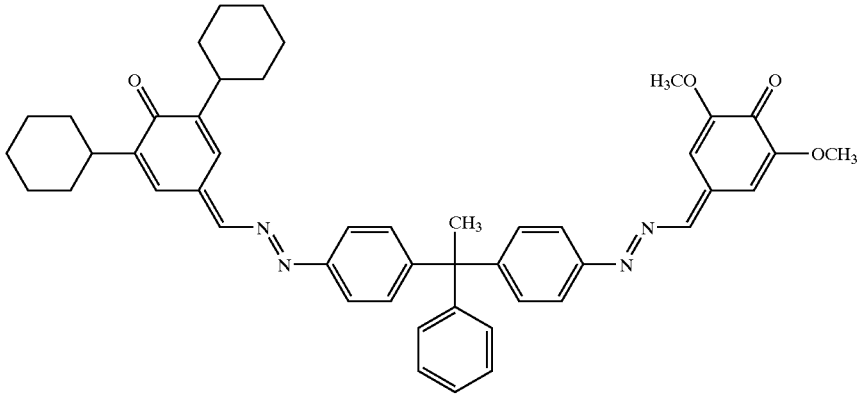
(1-9)
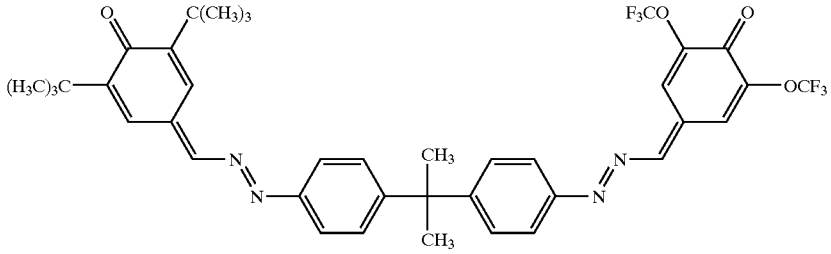
(1-10)
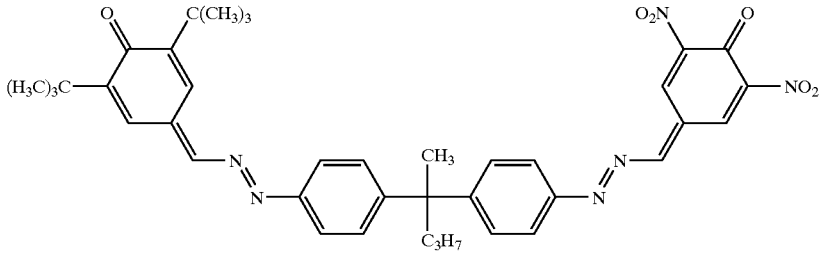

-continued
(1-11)
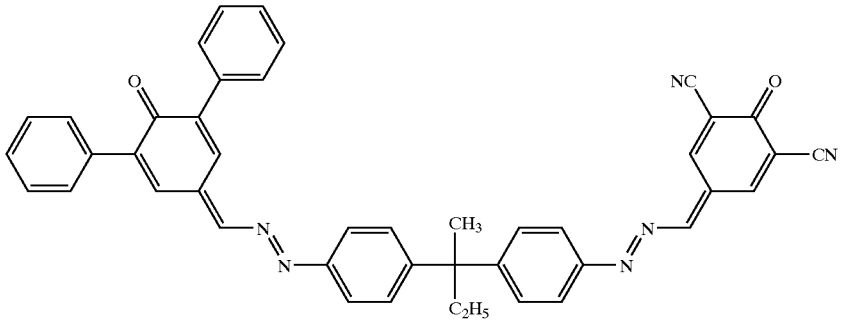
The following formulas (2-1) to (2-38) are specific examples of compounds of general formula (2):
(2-1)
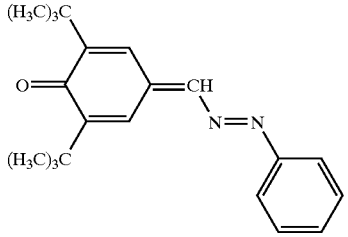
(2-2)
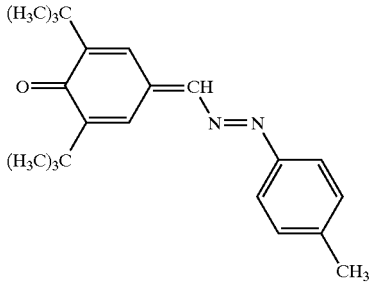
(2-3)
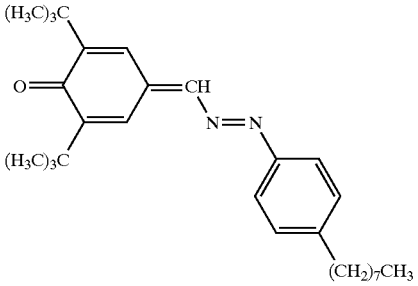
(2-4)
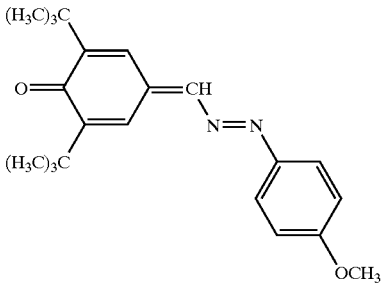
-continued
(2-5)
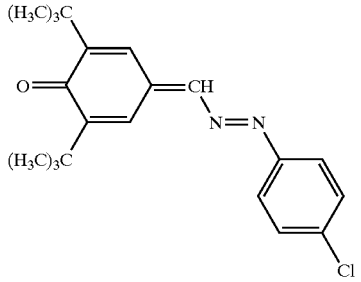
(2-6)
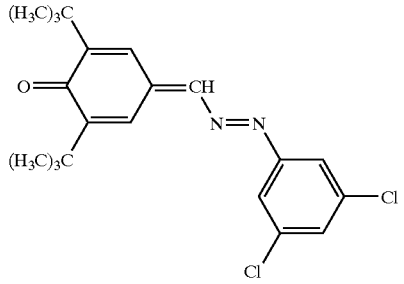
(2-7)
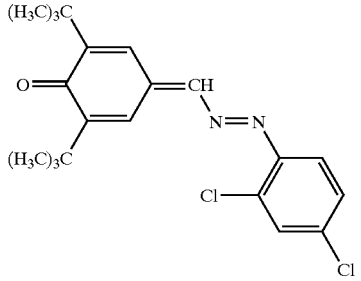
(2-8)
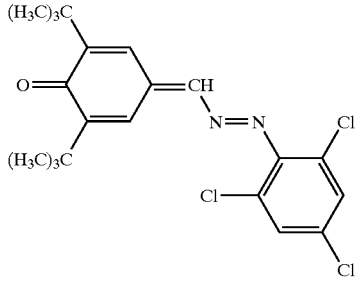

-continued
(2-9)
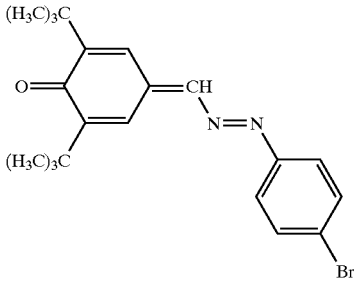
(2-10)
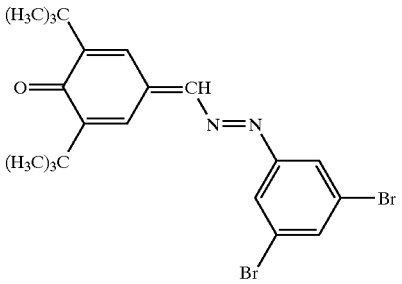
(2-11)
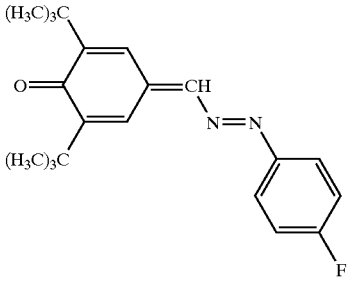
(2-12)
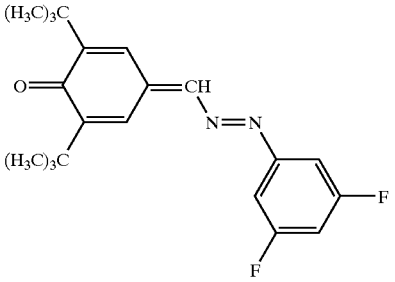
(2-13)
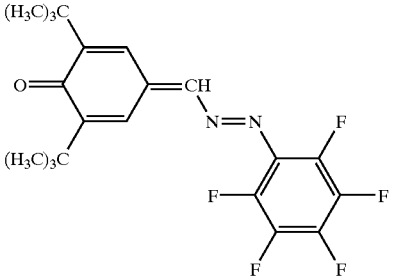
-continued
(2-14)
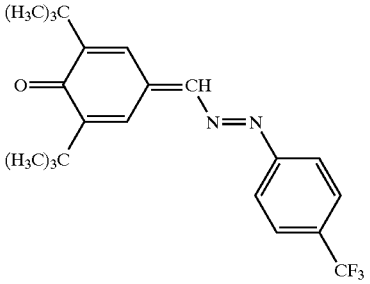
(2-15)
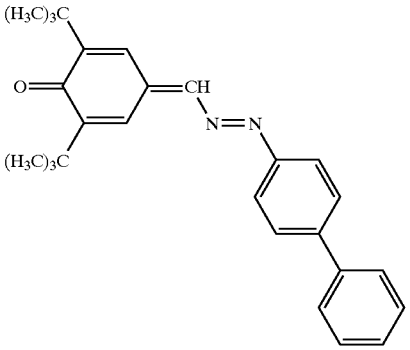
(2-16)
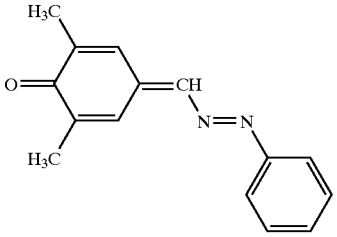
(2-17)
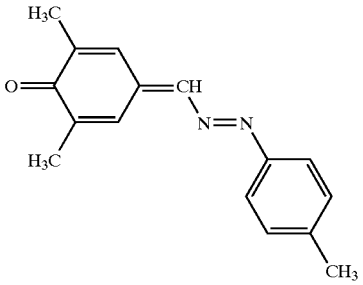
(2-18)
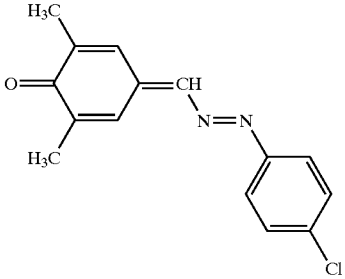

-continued
(2-19)
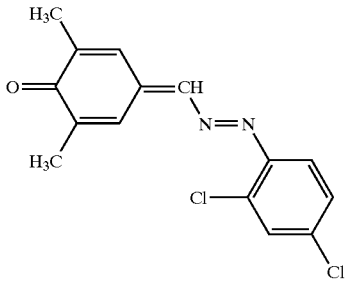
(2-20)
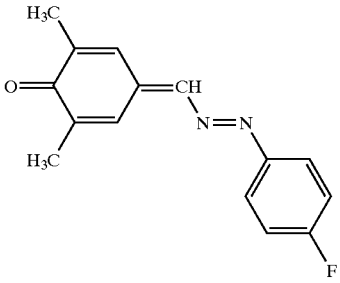
(2-21)
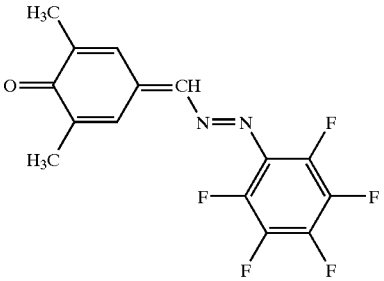
(2-22)
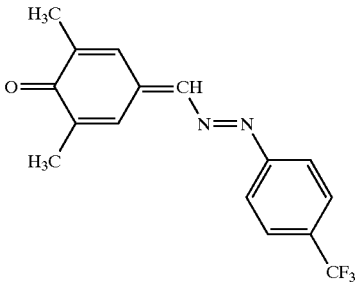
(2-23)
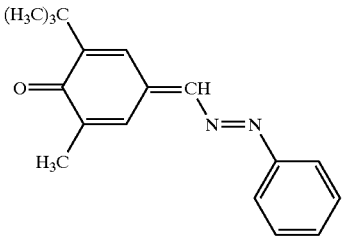
-continued
(2-24)
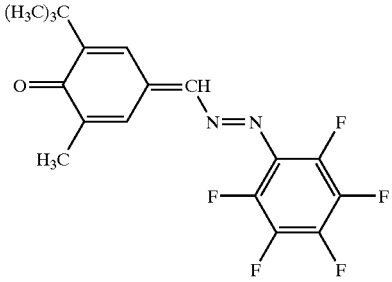
(2-25)
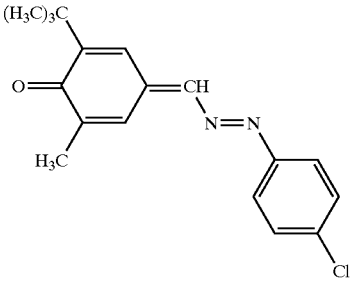
(2-26)
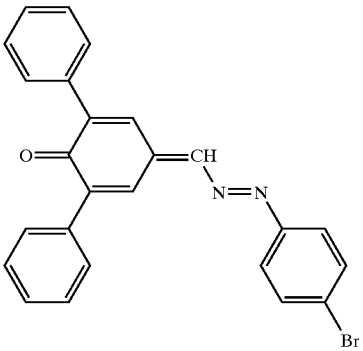
(2-27)
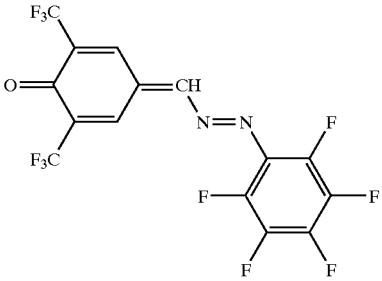
(2-28)
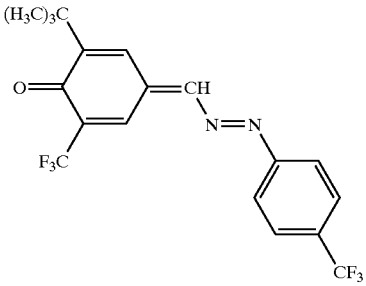

-continued
(2-29)
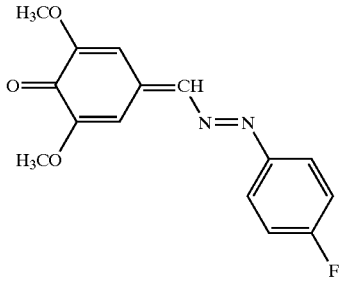
(2-30)
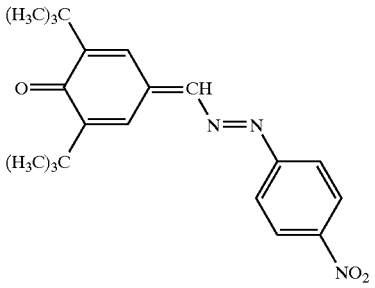
(2-31)
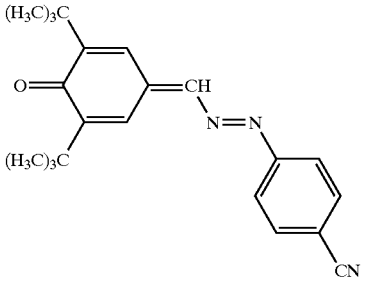
(2-32)
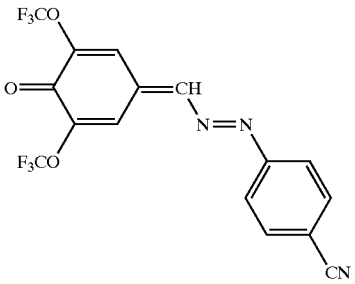
(2-33)
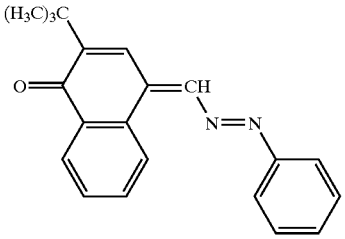
-continued
(2-34)
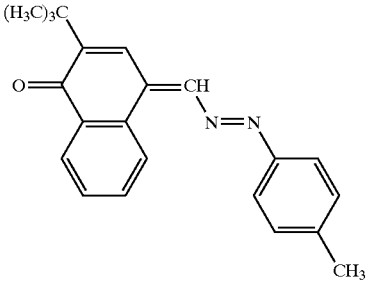
(2-35)
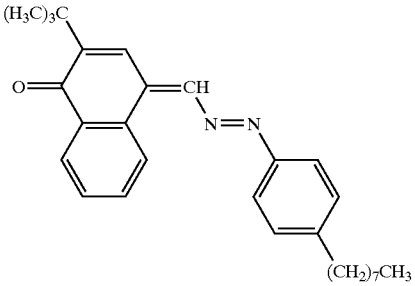
(2-36)
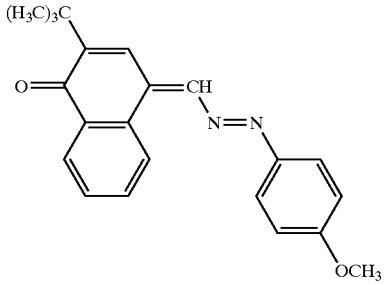
(2-37)
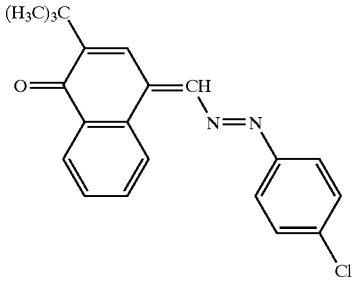
(2-38)
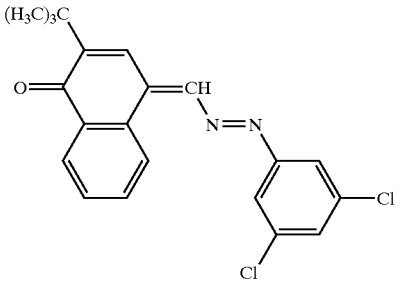

The following formulas (3-1) to (3-22) are specific examples of compounds of general formula (3):
(3-1)
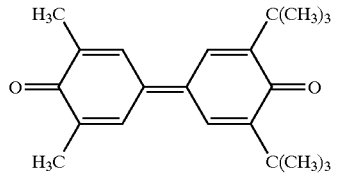
(3-2)
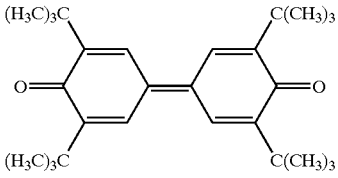
(3-3)
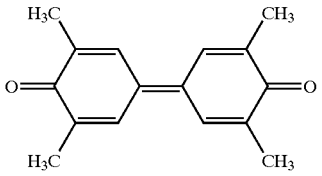
(3-4)
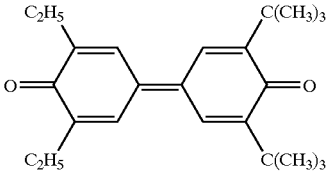
(3-5)
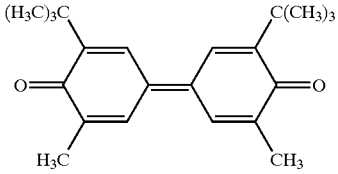
(3-6)
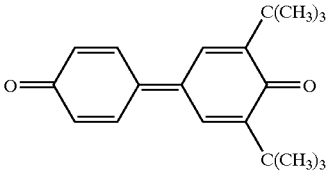
(3-7)
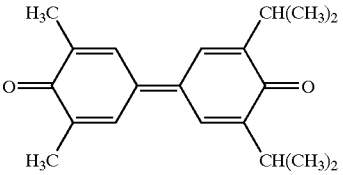
(3-8)
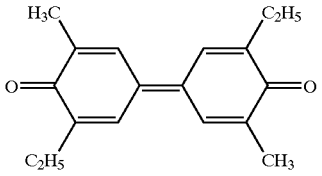
-continued
(3-9)
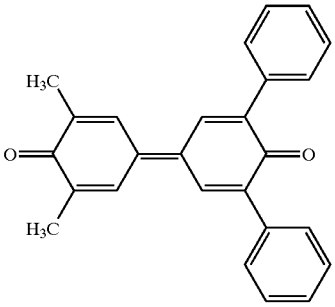
(3-10)
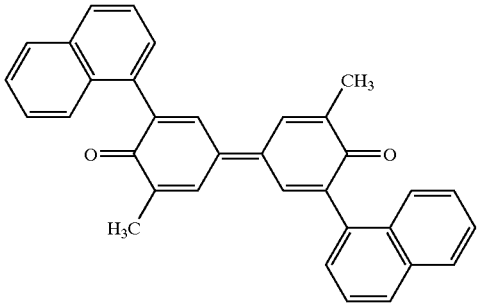
(3-11)
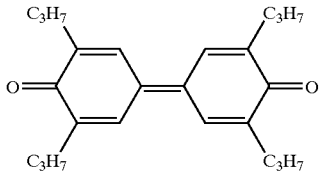
(3-12)
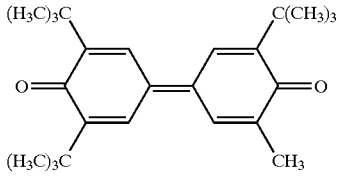
(3-13)
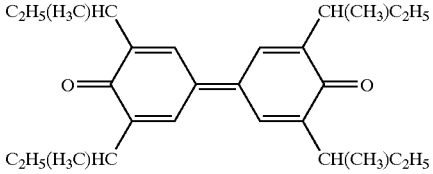
(3-14)
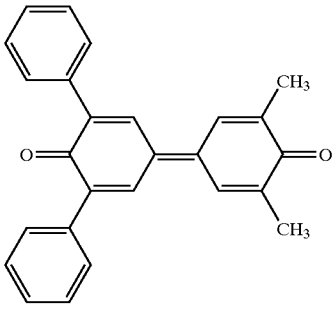

-continued
(3-15)
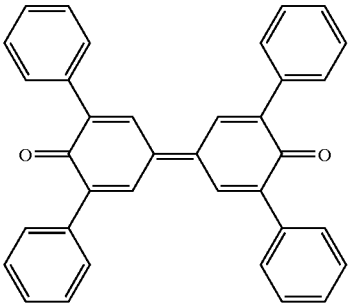
(3-16)
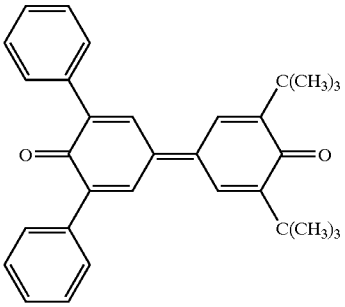
(3-17)
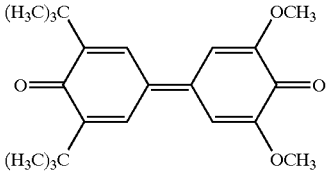
(3-18)
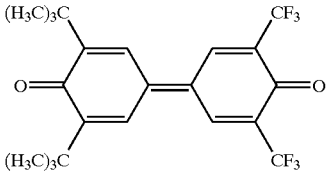
(3-19)
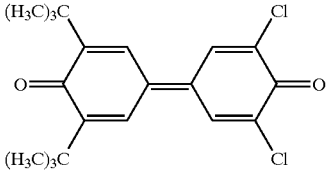
(3-20)
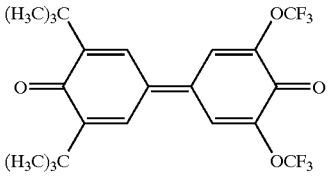
(3-21)
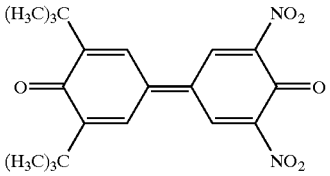
-continued
(3-22)
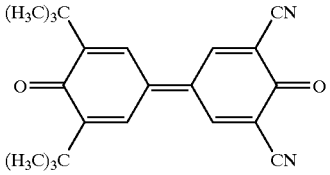
The following formulas (4-1) to (4-14) are specific examples of compounds of general formula (4):
(4-1)
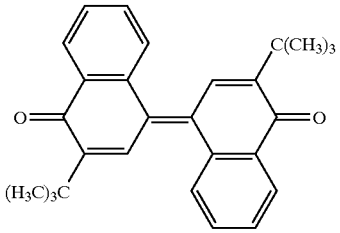
(4-2)
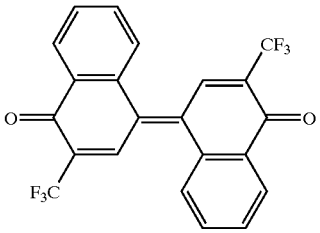
(4-3)
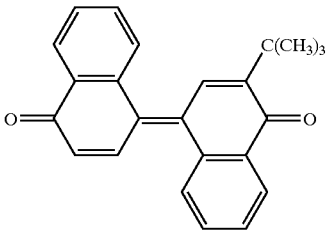
(4-4)
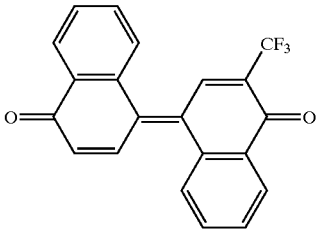
(4-5)
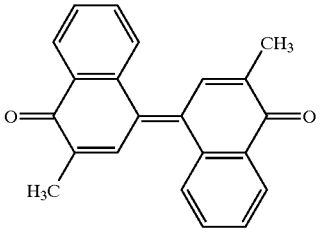

-continued
(4-6)
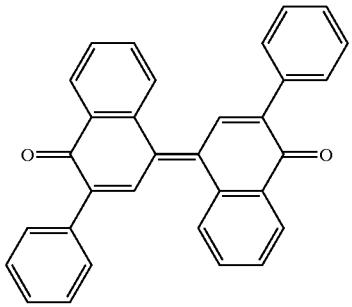
(4-7)
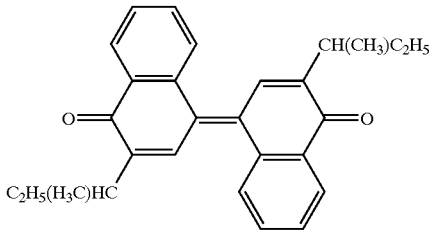
(4-8)
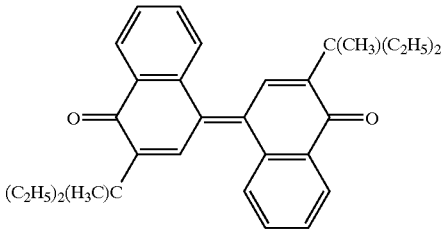
(4-9)
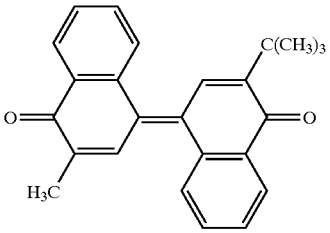
(4-10)
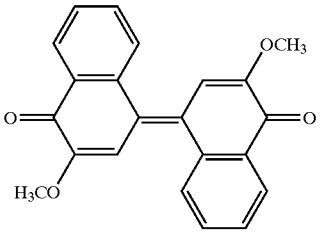
(4-11)
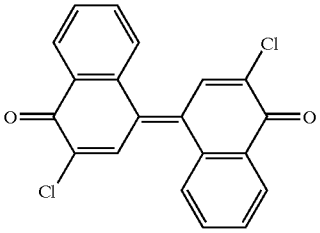
-continued
(4-12)
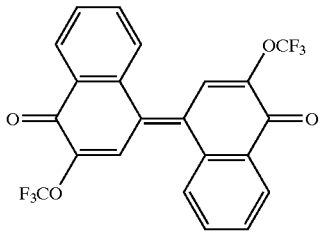
(4-13)
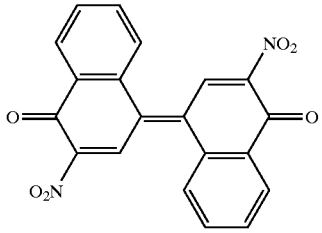
(4-14)
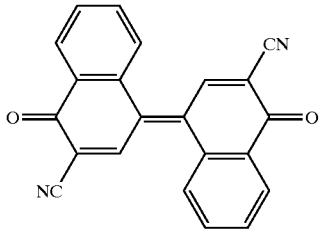
The following formulas (5-1) to (5-24) are specific examples of compounds of general formula (5):
(5-1)
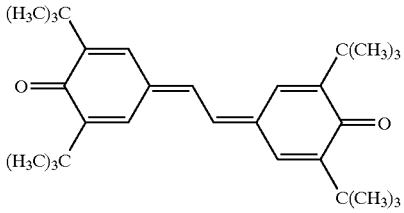
(5-2)
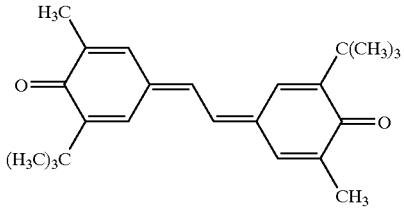
(5-3)
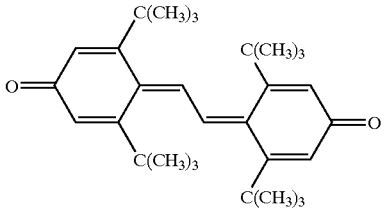

-continued
(5-4)
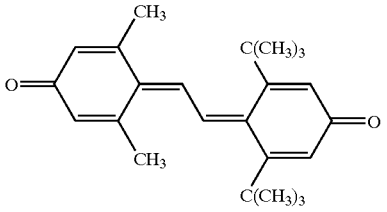
(5-5)
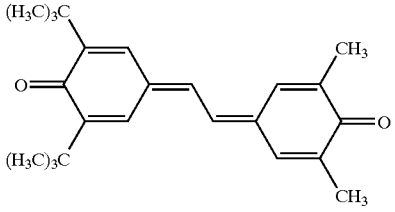
(5-6)
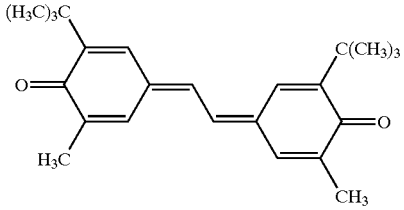
(5-7)
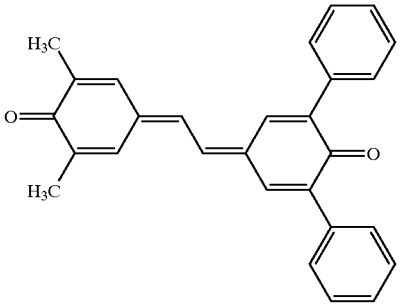
(5-8)
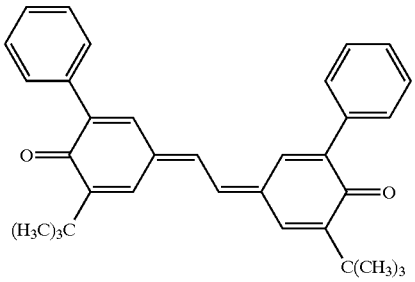
(5-9)
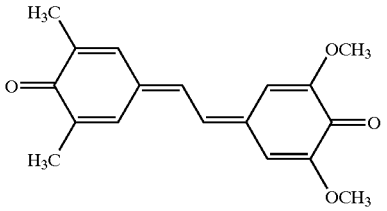
(5-10)
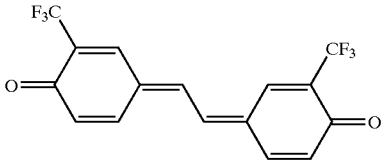
-continued
(5-11)
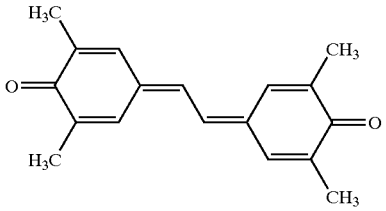
(5-12)
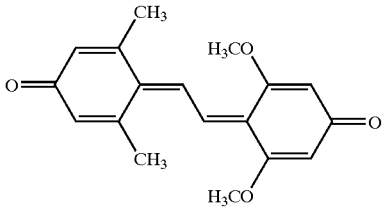
(5-13)
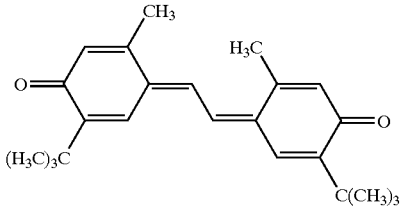
(5-14)
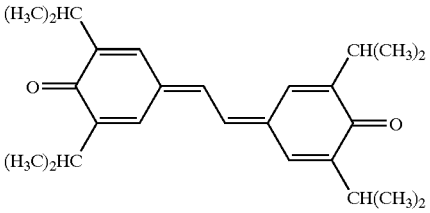
(5-15)
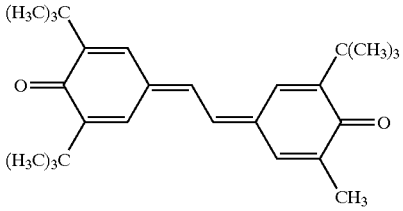
(5-16)
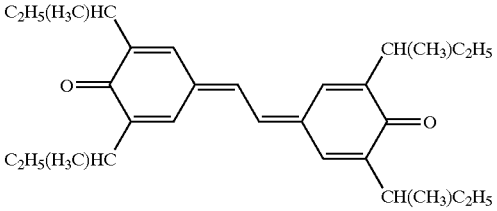

-continued
(5-17)
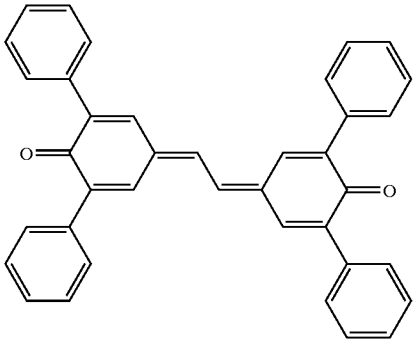
(5-18)
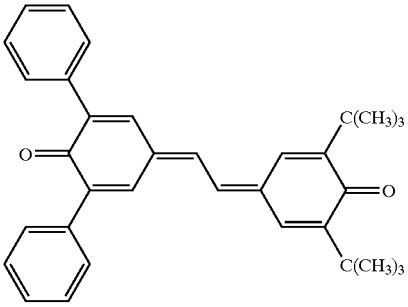
(5-19)
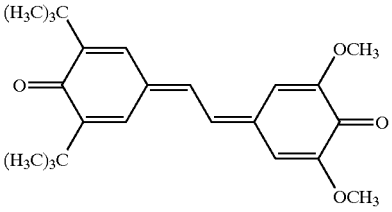
(5-20)
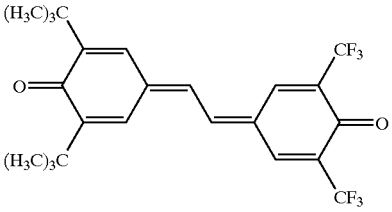
(5-21)
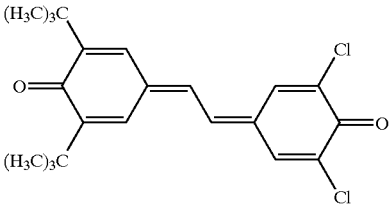
(5-22)
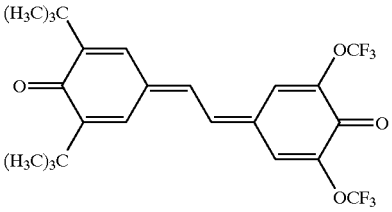
-continued
(5-23)
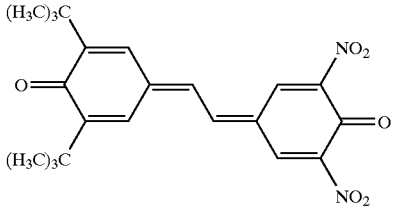
(5-24)
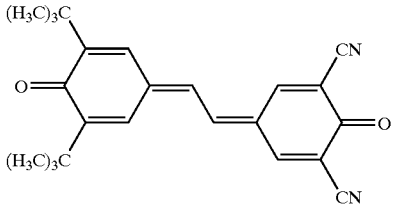
The following formulas (6-1) to (6-25) are specific examples of compounds of general formula (6):
(6-1)
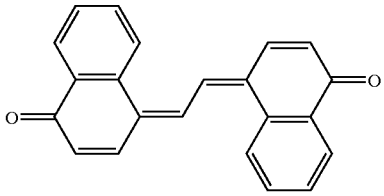
(6-2)
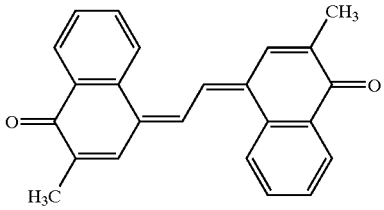
(6-3)
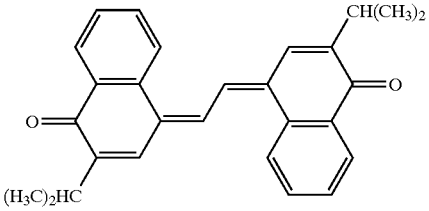
(6-4)
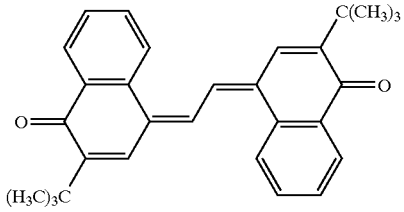
(6-5)
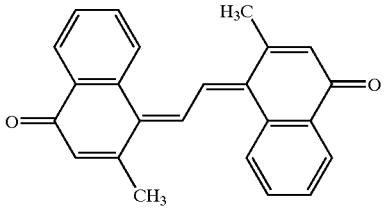

-continued
(6-6)
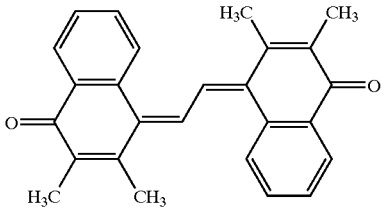
(6-7)
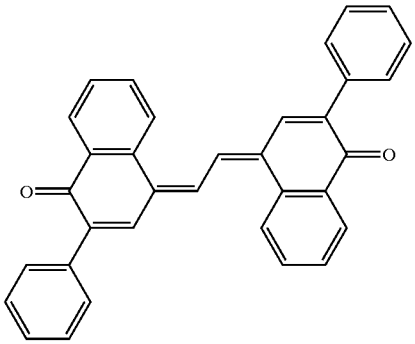
(6-8)
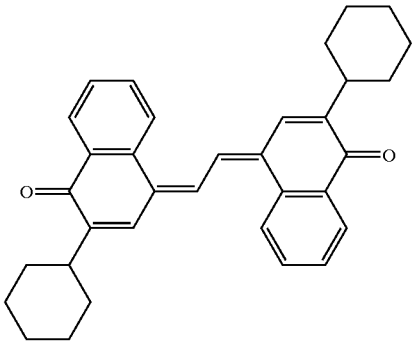
(6-9)
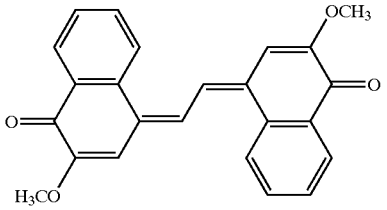
(6-10)
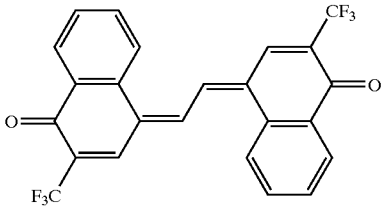
(6-11)
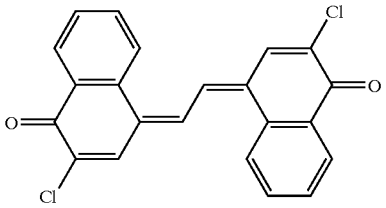
-continued
(6-12)
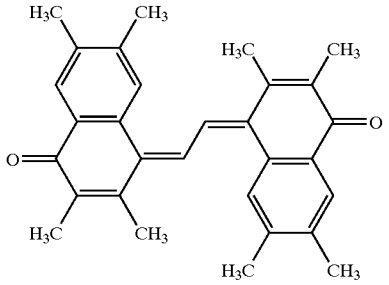
(6-13)
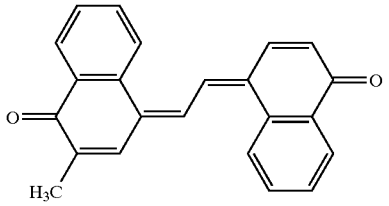
(6-14)
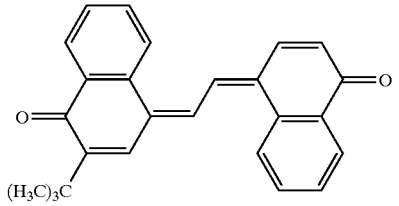
(6-15)
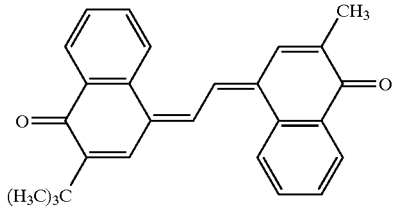
(6-16)
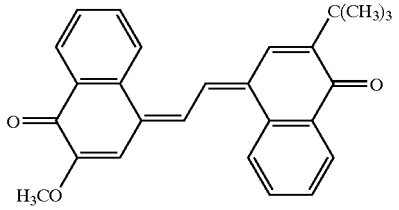
(6-17)
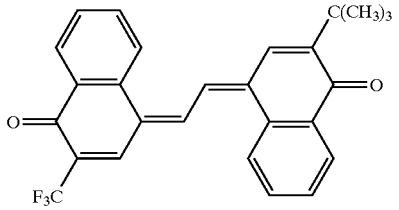
(6-18)
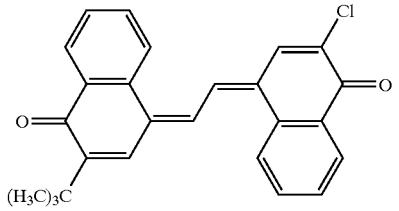

-continued (6-19)

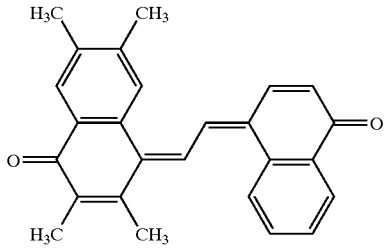

(6-20)

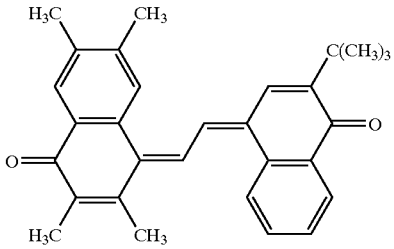

(6-21)

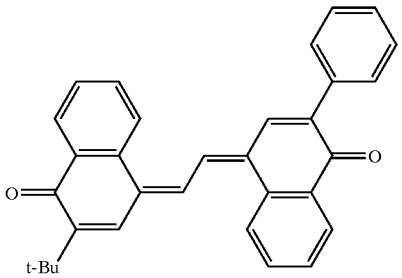

(6-22)

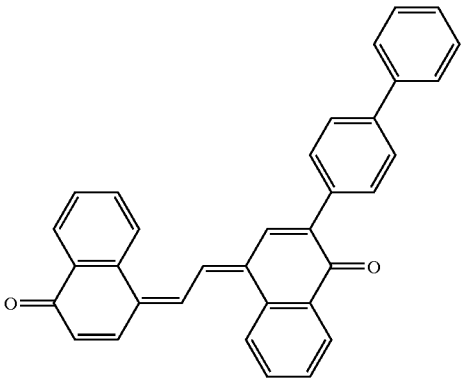

(6-23)

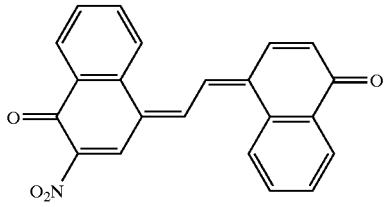

(6-24)

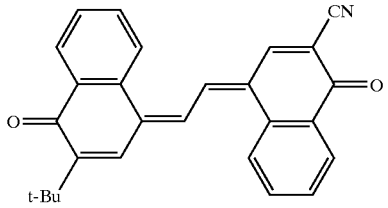

-continued (6-25)

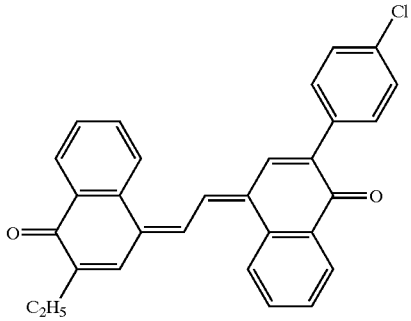

Preferably, the amount of exposure light will be set at a level in which the light potential is as low as possible. Specifically, it is preferred that the light potential of the photoreceptor 1 have the same polarity as the electric potential of an electrostatically charged photoreceptor 1 with respect to ground, and that the amount of exposure light is preferably set to 0 to 50V, and more preferably 0 to 10V.

The electrostatic device 2 can adapt methods that are well know in the art, such as the method of applying a high voltage to a charge wire that is provided adjacent to surface of the photoreceptor 1 and conducting a corona discharge, and the method of contacting a charging member such as a conductive roller or a charging brush and the like to the surface of the photoreceptor 1 and applying a charge thereto. However, in order to maintain the surface potential of the photoreceptor 1 at a constant level, it is preferable to use the method of contacting the surface of the photoreceptor 1 with an electrostatic material, or the method of providing a grid electrode between a charge wire on the electrostatic device and the photoreceptor 1 and conducting a corona discharge.

The electrostatic voltage that is applied to the photoreceptor 1 from the charging device 2 will be different depending upon such things as the photoreceptor 1, the characteristics of the toner, and the developing conditions. However, when a standard positive electrostatic type of photoreceptor is used, for example, it is preferable to set it such that the potential difference with respect to ground on the surface of the photoreceptor 1 is between +300 and +1000V.

Contact type or non-contact type developing devices known in the prior art can be used as the developing device 4, and either the dry or wet process may be used. The developing agent used in the developing device 4 may be either a one component system or two component system.

Any contact transfer method or non-contact transfer method known in the prior art may be used in the transfer device 5. Specifically, the transfer voltage can be applied to the photoreceptor 1 via the transfer medium 8 by means of a charger, a roller, a brush, a plate, or the like.

Like with the charging device 2, a corona discharge by a charge wire, or a conductive roller, may be used as the separation device 6, with the use of a corona discharge being particularly preferred. The separation voltage applied to the photoreceptor 1 by the separation device 6 is generally alternating current.

The charge removal device 7 is not particularly necessary in the present invention, but well known prior art devices such as an LED array or a fluorescent tube can be used so long as the photoreceptor 1 is sensitive to the wavelength used, and the charge remaining on the surface of the photoreceptor 1 can be removed with a sufficient amount of light.

The cleaning device 9 can use a cleaning method known in the prior art, such as the blade method, the fur brush method, and the roller cleaning method, or any other simple and effective method of removing toner.

2. Second Embodiment

The second embodiment will be described below by pointing out the difference between it and the first embodiment.

a. Electrophotographic Photoreceptor (i) Photosensitive Layer

The electrophotographic photoreceptor according to the second embodiment of the present invention is comprised of a support substrate, and a laminated photosensitive layer. The photosensitive layer includes a charge generating layer that contains a charge generating agent and which is provided on top of the support substrate, and a charge transport layer that contains a charge transport agent (a hole transport agent and/or an electron transport agent like in the first embodiment) and which is provided on top of the charge generating layer.

The laminated photosensitive layer is formed by first forming the charge generating layer containing a charge generating agent on top of the support substrate by using a CVD vapor growth method or by using an application means, and then applying an application liquid containing a charge transport agent and a binding resin on top of the charge generating layer with an application means, and drying the same, to form a charge transport layer thereon.

The sequence in which each of the aforementioned charge generating and charge transport layers in the laminated photosensitive layer are formed can be modified in accordance with the type of charge transport agent (hole transport agent and/or electron transport agent) used in the photosensitive layer. However, in the present embodiment, the uppermost layer that is exposed to light leaked from the flash fixing means must contain a charge transport agent in which the half maximum wavelength region of its absorption peak is in a visible region which includes the wavelength regions of the flash light but does not include the wavelength region of the exposure light.

Specific examples of laminated photosensitive layers include, but are not limited to:

(a) a negative electrostatic type of laminated photosensitive layer in which a charge generating layer containing a charge generating agent and, as needed, a charge transport agent (a hole transport agent and/or an electron transport agent) is formed on top of a conductive substrate, and a charge transport layer containing a hole transport agent having the aforementioned spectral characteristics is laminated on top of the charge generating layer; and (b) a positive electrostatic type of laminated photosensitive layer in which a charge generating layer containing a charge generating agent and, as needed, a charge transport agent (a hole transport agent and/or an electron transport agent) is formed on top of a conductive substrate, and a charge transport layer containing an electron transport agent having the aforementioned spectral characteristics is laminated on top of the charge generating layer.

Other charge generating layers/charge transport layers can be added to layers (a) and (b) according to need. However, a charge generating layer cannot be provided on top of a charge transport layer having the aforementioned spectral characteristics. The charge transport agent in a charge transport layer provided on top of a charge transport layer having the aforementioned spectral characteristics is not required to have the aforementioned spectral characteristics.

In addition, the charge generating layer may also contain a charge transport agent. The charge transport agent contain therein does not have to have the aforementioned spectral characteristics.

Among layers (a) and (b), the negative electrostatic type of laminated photosensitive layer (a) is preferred because its electrical characteristics, such as the degree of photosensitivity, the residual electric potential, and the like, are better than those of the positive electrostatic type.

Furthermore, it is preferred that the charge transport layer have (a) an absorbance wavelength that is in the wavelength regions of the flash light when at 50% or greater of its maximum intensity but not in the wavelength region of the exposure light, and (b) has a light absorbency of one unit or higher. It is preferred that the charge transport layer have a light absorbancy of 0.1 unit or less in the wavelength region of the exposure light.

Note that the charge transport agents, charge generating agents, binding resins, and support substrates of the second embodiment are identical with the first embodiment.

(ii) Production of the Photosensitive Layer

As noted above, if a charge generating layer in a laminated photosensitive layer is to be formed with a single charge generating agent, and if the charge generating agent is dispersed in the binding resin, it is preferred that 5–1000 parts by weight, and more preferably 30–500 parts by weight, of the charge generating agent be added to each 100 parts by weight of the binding resin.

If the charge generating layer is to also include a hole transport agent and a photoconductive layer identical with the first embodiment is to be formed, it is preferred that 1 to 200 parts by weight, and more preferably 5 to 100 parts by weight, thereof be added to each 100 parts by weight of the binding resin. In addition, if the charge generating layer is to contain an electron transport agent, it is preferred that 1 to 200 parts by weight, and more preferably 5 to 100 parts by weight, thereof be added to each 100 parts by weight of the binding resin.

In addition, if the charge transport layer is to include a hole transport agent, it is preferred that 10 to 500 parts by weight, and more preferably 25 to 200 parts by weight, thereof be added to each 100 parts by weight of the binding resin. Furthermore, if the charge transport layer is to contain an electron transport agent, it is preferred that 0.1 to 250 parts by weight, and more preferably 0.5 to 150 parts by weight, thereof be added to each 100 parts by weight of the binding resin.

In the laminated photosensitive layer, the charge generating layer is preferably 0.01 to 5 microns in thickness, and more preferably 0.1 to 3 microns in thickness, the photo conductive layer is preferably 0.01 to 100 microns in thickness, and more preferably 0.1 to 50 microns in thickness, and the charge transport layer is preferably 2 to 100 microns in thickness, and more preferably 5 to 50 microns in thickness.

Here, the number of parts by weight of the charge transport agent (hole transport agent/electron transport agent) that the charge transport layer contains can be suitably set within the aforementioned ranges so that the charge transport layer has the degree of light absorbance noted above. In addition, the charge transport layer can also be provided with the desired degree of light absorbance by adjusting the thickness thereof.

The other details relating to the formation of the photoreceptor are identical with those of the first embodiment.

b. Image Forming Device

The image forming device of the present invention is identical with that of the first embodiment.

Like in the first embodiment, the visual wavelength of the exposure light and the flash light must be taken into consideration with the photoreceptor used in this image forming device. However as noted above, in the present embodiment, the charge transport agent in the charge transport layer provided on top of the charge generating layer must have the half maximum wavelength region of its absorption peak in a visual region that includes the wavelength regions of the flash light but does not include the wavelength region of the exposure light.

3. EXAMPLES

Examples of the present invention will be described below.

a. Single Layer Photoreceptor

(i) Production Example 1

5 parts by weight of X type metal-free phthalocyanine as a charge generating agent, 95 parts by weight of Z type polycarbonate (Panlite TS2050, produced by Teijin Chemicals, Ltd.) and 5 parts by weight of polyester resin (RV200, produced by Toyobo Co.) as binding resins, 800 parts by weight of tetrahydrofuran as a dispersion agent, 60 parts by weight of a distyryl compound represented by general formula (7) as a hole transport agent:

(7)

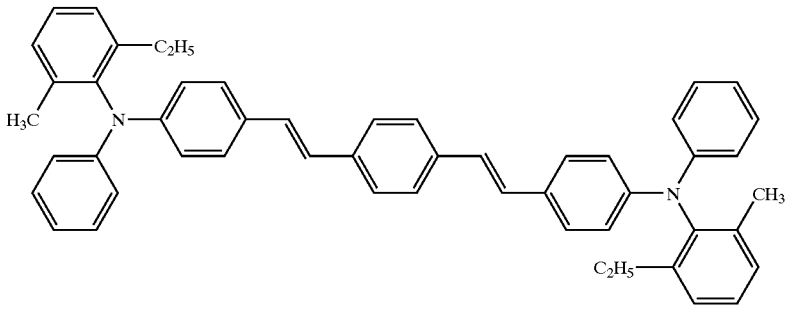

and 50 parts by weight of a dinaphthoquinone compound represented by general formula (4-7) as an electron transport agent were mixed together and dispersed in a ball mill for 50 hours, and an application liquid for a photoconductive layer was produced. Next, a fluoride resin blade was used to apply the application liquid to the top of a ϕ 30aluminum tube, and dried at 100 degrees centigrade for one hour, thereby forming a photoconductive layer with a thickness of 20 microns, and producing an electrophotographic photoreceptor.

(ii) Reference Example 1

A photoreceptor was produced to compare the degree of light absorbance. It is identical to that of Production Example 1 except that the X type metal-free phthalocyanine was not used.

(iii) Production Example 2

An electrophotographic photoreceptor according to Production Example 2 is identical to that produced in Production Example 1, except that the dinaphthoquinone compound represented by general formula (4-7) was replaced with the azoquinone compound represented by general formula (2-5).

(iv) Reference Example 2

A photoreceptor was produced to compare the degree of light absorbance. It is identical to that of Production Example 2 except that the X type metal-free phthalocyanine was not used.

(v) Production Example 3

An electrophotographic photoreceptor according to Production Example 3 is identical to that produced in Production Example 1, except that the distyryl compound represented by general formula (7) was replaced with the tryphenyidiamine compound represented by general formula (8):

(8)

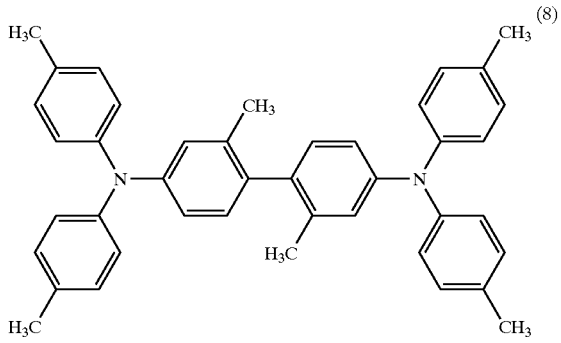

(vi) Reference Example 3

A photoreceptor was produced to compare the degree of light absorbance. It is identical to that of Production Example 3 except that the X type metal-free phthalocyanine was not used.

(vii) Production Example 4

An electrophotographic photoreceptor according to Production Example 4 is identical to that produced in Production Example 1, except that the distyryl compound represented by general formula (7) was replaced with the triphenyldiamine compound represented by general formula (8), and the dinaphthoquinone compound represented by general formula (4-7) was replaced with the naphthylenediimide compound represented by general formula (9):

(9)

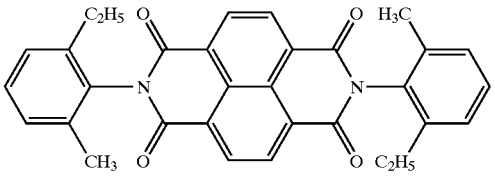

(viii) Reference Example 4

A photoreceptor was produced to compare the degree of light absorbance. It is identical to that of Production Example 4 except that the X type metal-free phthalocyanine was not used.

(ix) Production Example 5

An electrophotographic photoreceptor according to Production Example 5 is identical to that produced in Production Example 1, except that the distyryl compound represented by general formula (7) was replaced with the phenyidiamine compound represented by general formula (10):

(10)

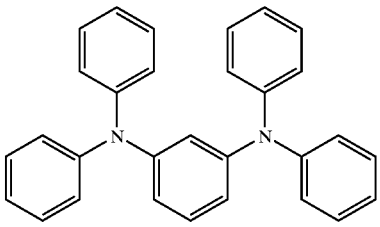

and the dinaphthoquinone compound represented by general formula (4-7) was replaced with the naphthoquinone compound represented by general formula (11):

(11)

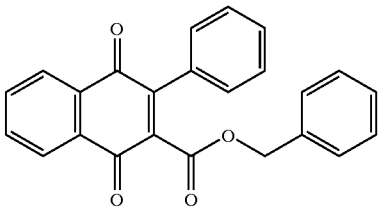

(x) Reference Example 5

A photoreceptor was produced to compare the degree of light absorbance. It is identical to that of Production Example 5 except that the X type metal-free phthalocyanine was not used.

(xi) Production Example 6

An electrophotographic photoreceptor according to Production Example 5 is identical to that produced in Production Example 1, except that the distyryl compound represented by general formula (7) was replaced with the phenanthrenediamine compound represented by general formula (12):

(12)

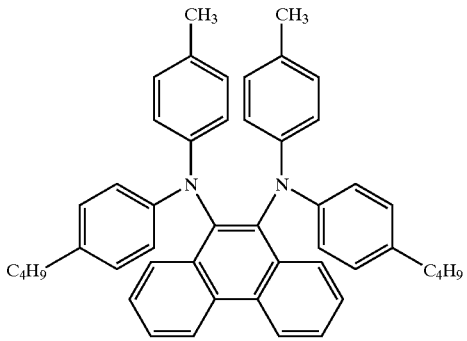

and the dinaphthoquinone compound represented by general formula (4-7) was replaced with the naphthylenediimide compound represented by general formula (9).

(xii) Reference Example 6

A photoreceptor was produced to compare the degree of light absorbance. It is identical to that of Production Example 6 except that the X type metal-free phthalocyanine was not used.

(xiii) Measuring the Degree of Light Absorbance

The absorption spectra in the visual region for the charge transport agents (hole transport agents/electron transport agents) used in the aforementioned Production Examples and Reference Examples were measured by the following method.

An application liquid produced by dissolving 100 parts by weight of Z type polycarbonate (Panlite TS2050, produced by Teijin Chemicals, Ltd.) and 1 part by weight of one of the charge transport agents used in the Production Examples and Reference Examples in 430 parts by weight of tetrahydrofuran was applied to the surface of a $\phi$ 30 aluminum tube with a fluoride resin blade, and a film 10 microns in thickness was formed thereon. This film was then stripped off the tube to produce a measurement sample. The absorption spectrum in the visual region was measured through the thickness of this measurement sample by means of a spectrophotometer, and the values obtained thereby were converted to values per each micron of thickness. One measurement sample was produced for each of the charge transport agents used in the Production Examples and Reference Examples.

Figure 5:
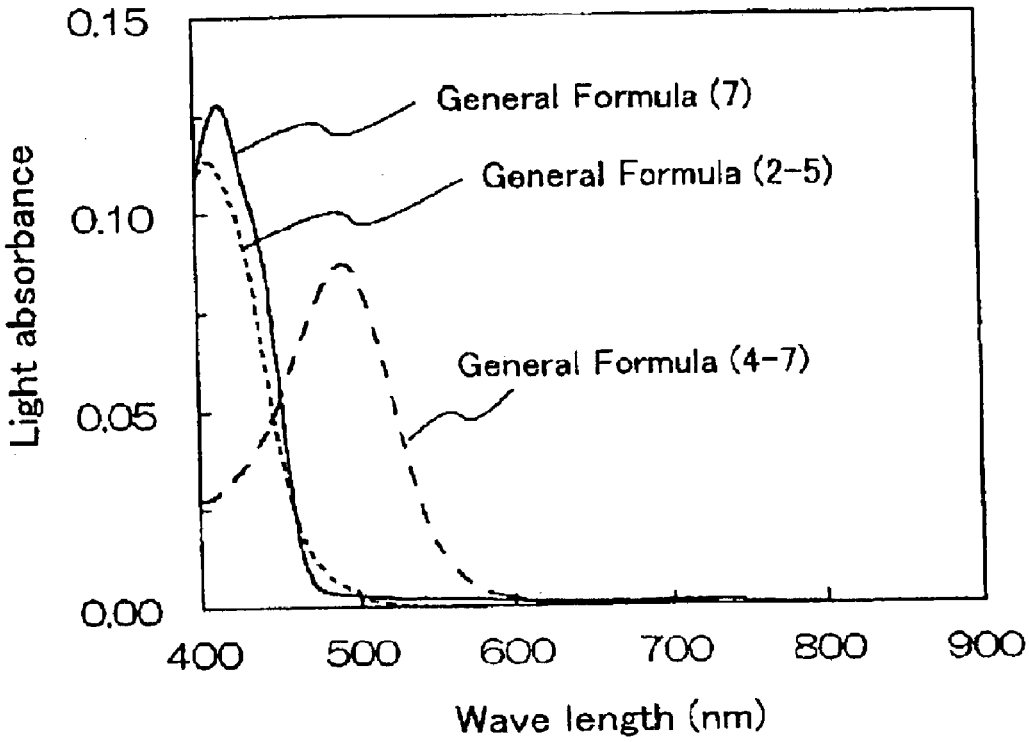
FIG. 5 shows the visual absorption spectra of charge transport agents used in each Production Example and Reference Example.

As a result of these measurements, it was found that the half maximum value or greater of the absorption peak for the distyryl compound of general formula (7) was in the 400 nm to 448 nm wavelength region, the half maximum value or greater of the absorption peak for the dinaphthoquinone compound of general formula (4-7) was in the 400 to 528 nm wavelength region, and the half maximum value or greater of the absorption peak for the azoquinone compound of general formula (2-5) was in the 400 nm to 443 nm wavelength region. In addition, the compounds represented by general formulas (8) to (1 2) did not absorb light in the visual region (400 to 900 nm). The absorption spectra per one micron of thickness for these charge transport agents (general formula (7), general formula (4-7), and general formula (2-5)) are shown in FIG. 5.

In addition, the absorption spectra in the visual region for the films formed in Reference Examples 1 to 3 were measured in the same manner as described above. However, the measurement samples used here were the photosensitive layers stripped off from the photoreceptors produced in these reference examples. The absorbance spectra from these layers were measured, and the values obtained thereby were converted to values per one micron of thickness.

Figure 6:
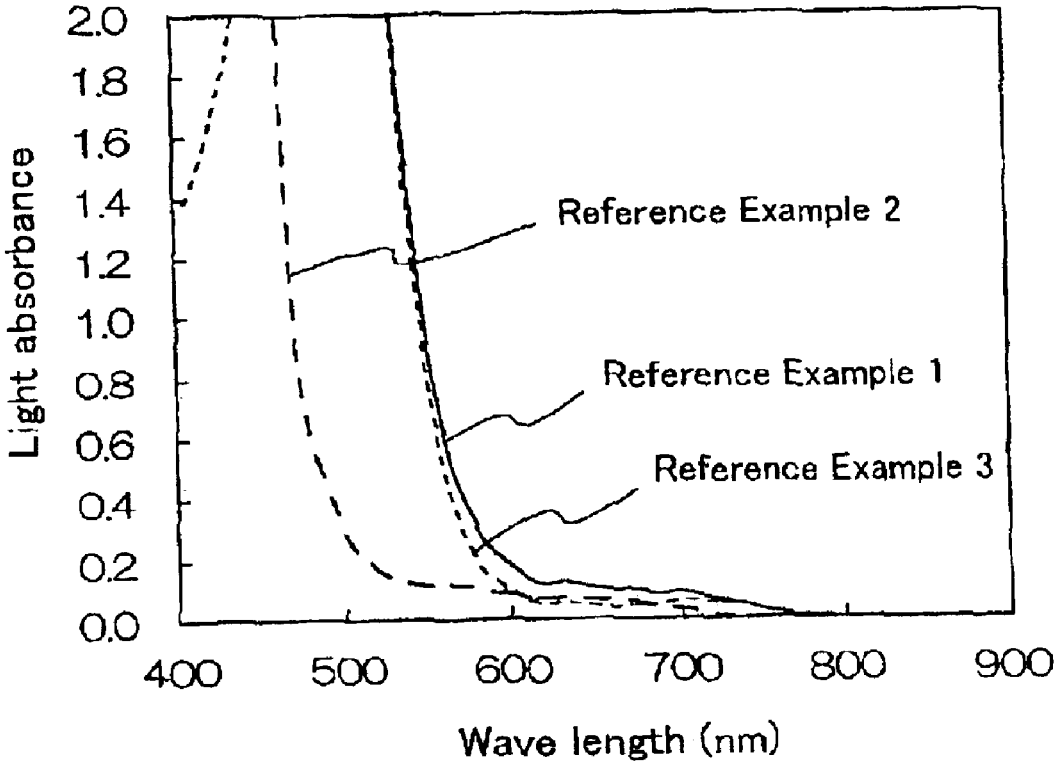
FIG. 6 shows the visual absorption spectra of layers formed in Reference Examples 1 to 3.

As a result of these measurements, it was found that Reference Example 1 had an absorbance per one micron of film thickness of one or greater in the 400 nm to 675 nm wavelength region, Reference Example 2 had an absorbance per one micron of film thickness of one or greater in the 400 nm to 584 nm wavelength region, and Reference Example 3 had an absorbance per one micron of film thickness of one or greater in the 400 nm to 546 nm wavelength region. It was also found that Reference Examples 1 and 3 had an absorbance per one micron of film thickness of 0.01 or less in the 777 nm to 900 nm wavelength region, and that Reference Example 2 had an absorbance per one micron of film thickness of 0.01 or less in the 723 nm to 900 nm wavelength region. Note that Reference Examples 4 to 6 did not absorb any light in the visual region of 400 nm to 900 nm. The absorption spectra per one micron of thickness for Reference Examples 1 to 3 are shown in FIG. 6.

(xv) Examples 1 to 3 and Comparative Examples 1 to 5

The production examples 1 to 6 for the single layer photoreceptor were each loaded into an electrostatic copying machine (a modified KM-4850w produced by Kyocera Mita), the flash lamps shown in Table 2 were installed therein, and the image formation process was carried out. 10,000 images were continuously produced, and the 10th image and the 10,000th image produced thereby were visually evaluated for irregularities, density, and fogging.

Note that the electrostatic copying machine was set as follows:

Charger: scorotron (surface potential of the photoreceptor was charged to approximately 700V)

Exposure light: laser (780 nm wavelength)

Developer: reverse developer

Transfer device: transfer roller

Cleaning: cleaning blade method

Fixing: flash fixing (xenon lamp (visual spectral intensity as shown in FIG. 2), halogen lamp (visual spectral intensity as shown in FIG. 3))

Note that Table 2 shows the wavelength of the light from the flash lamps at maximum intensity, and the wavelength regions of the light when the intensity of the flash lamps is 50% or greater of maximum.

TABLE 2

| Flash Lamp | Wavelength at maximum intensity (nm) | Wavelength regions when intensity is 50% or more of maximum (nm) | | |
|---|---|---|---|---|
| Xenon lamp | 830 | 400 to 586 | 817 to 844 | 882 to 900 |
| Halogen lamp | 900 | 705 to 990 | — | — |

The images were visually evaluated for irregularities, and placed in one of the following three categories:

◎: No image irregularities found

○: Some insignificant image irregularities found x: Image irregularities found which reduce image quality The images were visually evaluated for fogging, and placed in one of the following four categories:

◎: No image fogging

○: Some insignificant image fogging produced

Δ: Image fogging produced that can be noticed at a glance x: Severe image fogging produced The densities of the images were visually evaluated, and placed in one of the following four categories:

◎: Image density was sufficient

○: The gray portions were somewhat weak, but the density of the text and black solid portions was sufficient Δ: Portions of text and lines in image are narrowed x: Black solid portions smeared or rubbed thin The results of the aforementioned evaluations are shown below in Table 3.

TABLE 3

| | Photoreceptor | Charge generating agent | Flash lamp | 10th image | | | 10,000th image | | |
|---|---|---|---|---|---|---|---|---|---|
| | | | | Irregularities | Fogging | Density | Irregularities | Fogging | Density |
| Example 1 | Production Example 1 | X-$H_2$Pc | Xenon | ◎ | ◎ | ◎ | ◎ | ◎ | ◎ |
| Example 2 | Production Example 2 | X-$H_2$Pc | Xenon | ○ | ◎ | ◎ | ○ | ○ | ○ |
| Example 3 | Production Example 3 | X-$H_2$Pc | Xenon | ◎ | ◎ | ◎ | ◎ | ◎ | ◎ |
| Comparative Example 1 | Production Example 1 | X-$H_2$Pc | Halogen | X | ◎ | ◎ | X | Δ | Δ |
| Comparative Example 2 | Production Example 2 | X-$H_2$Pc | Halogen | X | ◎ | ◎ | X | Δ | Δ |
| Comparative Example 3 | Production Example 4 | X-$H_2$Pc | Xenon | X | ◎ | ◎ | X | Δ | Δ |
| Comparative Example 4 | Production Example 5 | X-$H_2$Pc | Xenon | X | ◎ | ◎ | X | Δ | Δ |

TABLE 3-continued

| | Photoreceptor | Charge generating agent | Flash lamp | 10th image | | | 10,000th image | | |
|---|---|---|---|---|---|---|---|---|---|
| | | | | Irregularities | Fogging | Density | Irregularities | Fogging | Density |
| Comparative Example 5 | Production Example 6 | X-$H_2$Pc | Xenon | X | ⊚ | ⊚ | X | Δ | Δ |

Examples 1 to 3 in Table 3 use a charge transport agent in which the half maximum wavelength region of its absorption peak is in a visual region that includes the wavelength regions of the flash light when its intensity is 50% or greater of its maximum but does not include the wavelength region of the exposure light. Comparative Examples 1 to 5 use a charge transport agent in which the half maximum wavelength region of its absorption peak is not in that wavelength region.

Table 3 shows that no image irregularities were produced in Examples 1 and 3, and that image fogging and image density do not worsen after repeated image formation. Example 2 showed only an insignificant decline in image fogging and image density due to repeated image formation.

On the other hand, Comparative Examples 1 to 5 produced severe image irregularities, and image fogging and image density worsened due to repeated image formation. This is thought to be due to the residual charge in the photosensitive layer and the deterioration of the charge generating agent, which itself is caused by the charge transfer agent not absorbing light leaked from the halogen lamp.

b. Laminated Photoreceptor (i) Production Example 11

1 part by weight of Y type titanyl phthalocyanine was added to 39 parts by weight of ethylcellosolve as a dispersing agent, and was dispersed using a ultrasonic disperser. To this dispersed liquid was added 1 part by weight of polyvinyl butyral (BM-1 produced by Sekisui Chemical) as a binding resin dissolved in 9 parts by weight of ethylcellosolve. An ultrasonic disperser was again used to disperse this mixture, and an application liquid for forming a charge generating layer in a laminated photosensitive layer was produced. Next, a fluoride resin blade was used to apply this application liquid to the surface of a ϕ 30 aluminum tube and dried for 5 minutes at 110 degrees centigrade, thereby forming a charge generating layer having a thickness of 0.5 microns.

Next, 0.95 part by weight of Z type polycarbonate (Panlite TS2050, produced by Teijin Chemicals) and 0.05 parts by weight of polyester resin (RV200, produced by Toyobo Co.) as binding resins, 0.8 parts by weight of the distyryl compound represented by general formula (7) as a hole transport agent:

(7)

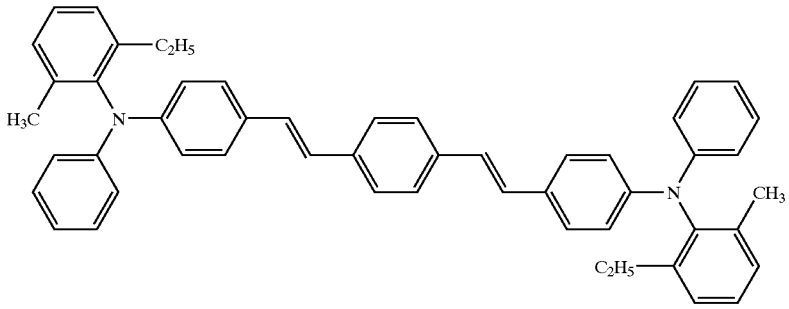

and 0.05 parts by weight of a dinaphthoquinone compound represented by general formula (4-7) as an electron transport agent, were mixed together with 8 parts by weight of tetrahydrofuran and dispersed, and an application liquid for a charge transport layer was obtained. Next, a fluoride resin blade was used to apply the application liquid to the top of the aforementioned charge generating layer, and dried at 110 degrees centigrade for 30 minutes, to thereby form a charge transport layer with a thickness of 30 microns and produce an electrophotographic photoreceptor.

(ii) Reference Example 11

A photoreceptor was produced to compare the degree of light absorbance. It is identical to that of Production Example 11 except that it does not have a charge generating layer.

(iii) Production Example 12

An electrophotographic photoreceptor according to Production Example 12 is identical to that produced in Production Example 11, except that the dinaphthoquinone compound represented by general formula (4-7) was replaced with the azoquinone compound represented by general formula (2-5).

(iv) Reference Example 12

A photoreceptor was produced to compare the degree of light absorbance. It is identical to that of Production Example 12 except that it does not have a charge generating layer.

(v) Production Example 13

An electrophotographic photoreceptor according to Production Example 13 is identical to that produced in Production Example 11, except that the distyryl compound represented by general formula (7) was replaced with the tryphenyldiamine compound represented by general formula (8):

(8)

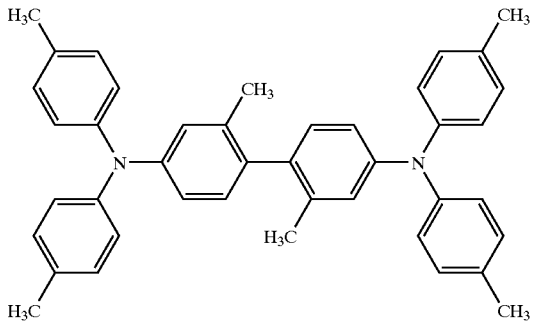

(vi) Reference Example 13

A photoreceptor was produced to compare the degree of light absorbance. It is identical to that of Production Example 13 except that the X type metal-free phthalocyanine was not used.

(vii) Production Example 14

An electrophotographic photoreceptor according to Production Example 14 is identical to that produced in Production Example 11, except that the distyryl compound represented by general formula (7) was replaced with the triphenyldiamine compound represented by general formula (8), and the dinaphthoquinone compound represented by general formula (4-7) was replaced with the naphthylenediimide compound represented by general formula (9):

(9)

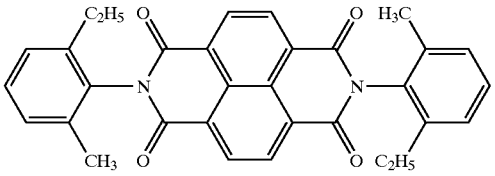

(viii) Reference Example 14

A photoreceptor was produced to compare the degree of light absorbance. It is identical to that of Production Example 14 except that the X type metal-free phthalocyanine was not used.

(ix) Production Example 15

An electrophotographic photoreceptor according to Production Example 15 is identical to that produced in Production Example 11, except that the distyryl compound represented by general formula (7) was replaced with the phenyldiamine compound represented by general formula (10):

(10)

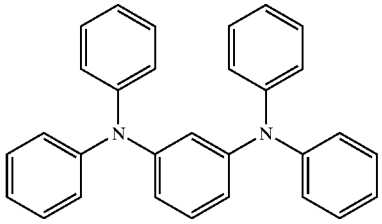

and the dinaphthoquinone compound represented by general formula (4-7) was replaced with the naphthoquinone compound represented by general formula (11):

(11)

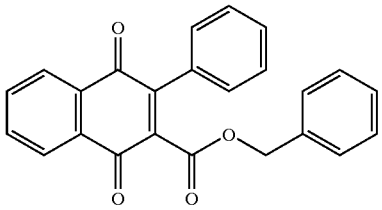

(x) Reference Example 15

A photoreceptor was produced to compare the degree of light absorbance. It is identical to that of Production Example 15 except that the X type metal-free phthalocyanine was not used.

(xi) Production Example 16

An electrophotographic photoreceptor according to Production Example 15 is identical to that produced in Production Example 11, except that the distyryl compound represented by general formula (7) was replaced with the phenanthrenediamine compound represented by general formula (12):

(12)

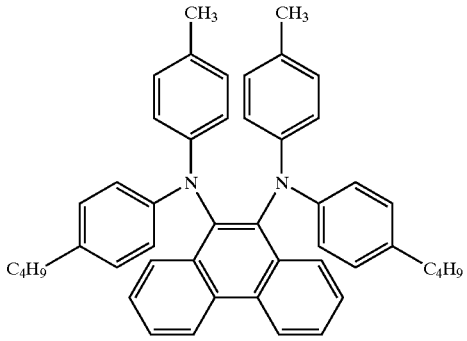

and the dinaphthoquinone compound represented by general formula (4-7) was replaced with the naphthylenediimide compound represented by general formula (9).

(xii) Reference Example 16

A photoreceptor was produced to compare the degree of light absorbance. It is identical to that of Production Example 16 except that the X type metal-free phthalocyanine was not used.

(xiii) Measuring the Degree of Light Absorbance

The absorption spectra in the visual region for the charge transport agents (hole transport agents/electron transport agents) used in the aforementioned production examples and Reference Examples were measured by the following method.

An application liquid produced by dissolving 100 parts by weight of Z type polycarbonate (Panlite TS2050, produced by Teijin Chemicals, Ltd.) and 1 part by weight of one of the charge transport agents used in the Production Examples and Reference Examples in 430 parts by weight of tetrahydrofuran was applied to the surface of a ϕ 30 aluminum tube with a fluoride resin blade, and a film 10 microns in thickness was formed thereon. This film was then stripped off the tube to produce a measurement sample. The absorption spectrum in the visual region was measured through the thickness of this measurement sample by means of a spectrophotometer, and the values obtained thereby were converted to values per each micron of thickness. One measurement sample was produced for each of the charge transport agents used in the Production Examples and Reference Examples.

As a result of these measurements, it was found that the half value or greater of the absorption peak for the distyryl compound of general formula (7) was in the 400 nm to 448 nm wavelength region, the half value or greater of the absorption peak for the dinaphthoquinone compound of general formula (4-7) was in the 400 to 528 nm wavelength region, and the half value or greater of the absorption peak for the azoquinone compound of general formula (2-5) was in the 400 nm to 443 nm wavelength region. In addition, the compounds represented by general formulas (8) to (12) did not absorb light in the visual region (400 to 900 nm). Note that the absorption spectra per one micron of thickness for the charge transport agents (general formula (7), general formula (4-7), and general formula (2-5)) are shown in FIG. 5.

In addition, the absorption spectra in the visual region for the films formed in Reference Examples 11 to 13 were measured in the same manner as described above. However, the measurement samples used here were the photosensitive layers stripped off from the photoreceptors produced in these reference examples. The absorbance spectra from these layers were measured, and the values obtained thereby were converted to values per one micron of thickness.

Figure 7:
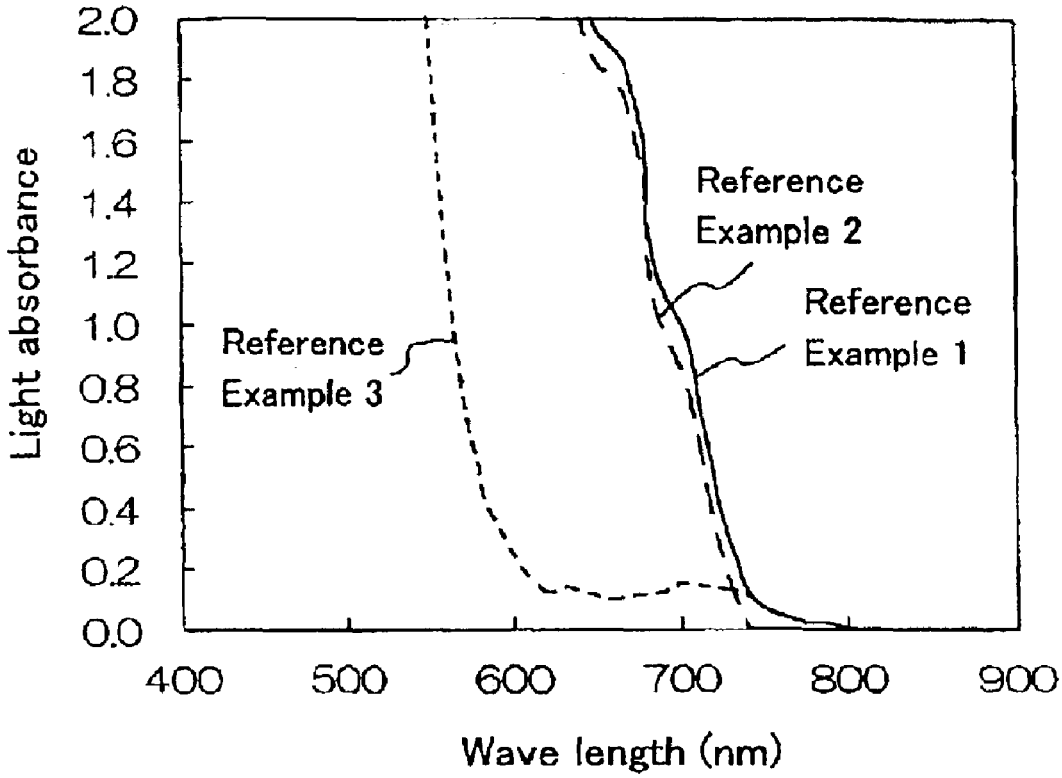
FIG. 7 shows the visual absorption spectra of layers formed in Reference Examples 11 to 13.

As a result of these measurements, it was found that Reference Example 11 had an absorbance per one micron of film thickness of one or greater in the 400 nm to 700 nm wavelength region, Reference Example 12 had an absorbance per one micron of film thickness of one or greater in the 400 nm to 695 nm wavelength region, and Reference Example 13 had an absorbance per one micron of film thickness of one or greater in the 400 nm to 565 nm wavelength region. It was also found that Reference Example 11 had an absorbance per one micron of film thickness of 0.01 or less in the 744 nm to 900 nm wavelength region, Reference Example 12 had an absorbance per one micron of film thickness of 0.01 or less in the 734 nm to 900 nm wavelength region, and Reference Example 13 had an absorbance per one micron of film thickness of 0.01 or less in the 744 nm to 900 nm wavelength region. Note that Reference Examples 14 to 16 did not absorb any light in the visual region of 400 nm to 900 nm. The absorption spectra of the charge transport agents in Reference Examples 11 to 13 are shown in FIG. 7.

(xv) Examples 11 to 14 and Comparative Examples 11 to 14

Production Examples 11 to 16 for the laminated photoreceptor were each loaded into an electrostatic copying machine (a modified LBP-450 produced by Canon), the flash lamps shown in Table 2 were installed therein, and the image formation process was carried out. 10,000 images were continuously produced, and the 10th image and the 10,000th image produced thereby were visually evaluated for irregularities, density, and fogging.

Note that the electrostatic copying machine was set as follows:

Charger: electrostatic roller (surface potential of the photoreceptor was charged to approximately 700V)

Exposure light: laser (780 nm wavelength)

Developer: reverse developer

Transfer device: transfer roller

Cleaning: cleaning blade method

Fixing: flash fixing (xenon lamp (visual spectral intensity as shown in FIG. 2), halogen lamp (visual spectral intensity as shown in FIG. 3))

Note that Table 2 shows the wavelength of the flash light at maximum intensity, and the wavelength regions at which the intensity of the flash light is 50% or greater of maximum.

The images were visually evaluated for irregularities, and placed in one of the following three categories:

◎: No image irregularities found

○: Some insignificant image irregularities found x: Image irregularities found which reduce image quality The images were visually evaluated for fogging, and placed in one of the following four categories:

◎: No image fogging

○: Some insignificant image fogging produced

Δ: Image fogging produced that can be noticed at a glance x: Severe image fogging produced The densities of the images were visually evaluated, and placed in one of the following four categories:

◎: Image density was sufficient

○: The gray portions were somewhat weak, but the density of the text and black solid portions was sufficient Δ: Portions of text and lines in image are narrowed x: Black solid portions smeared or rubbed thin The results of the aforementioned evaluations are shown below in Table 4.

TABLE 4

| | Photoreceptor | Charge generating agent | Flash lamp | 10th image | | | 10,000th image | | |
|---|---|---|---|---|---|---|---|---|---|
| | | | | Irregularities | Fogging | Density | Irregularities | Fogging | Density |
| Example 11 | Production Example 11 | Y-TiOPc | Xenon | ◎ | ◎ | ◎ | ◎ | ◎ | ◎ |
| Example 12 | Production Example 12 | Y-TiOPc | Xenon | ◎ | ◎ | ◎ | ◎ | ◎ | ◎ |
| Example 13 | Production Example 13 | Y-TiOPc | Xenon | ◎ | ◎ | ◎ | ◎ | ◎ | ◎ |
| Comparative Example 11 | Production Example 11 | Y-TiOPc | Halogen | X | ◎ | ◎ | X | Δ | Δ |
| Comparative Example 12 | Production Example 12 | Y-TiOPc | Halogen | X | ◎ | ◎ | X | Δ | Δ |
| Comparative Example 13 | Production Example 14 | Y-TiOPc | Xenon | X | ◎ | ◎ | X | Δ | Δ |
| Comparative Example 14 | Production Example 15 | Y-TiOPc | Xenon | X | ◎ | ◎ | X | Δ | Δ |
| Comparative Example 15 | Production Example 16 | Y-TiOPc | Xenon | X | ◎ | ◎ | X | Δ | Δ |

Examples 11 to 13 in Table 4 use a charge transport agent in which the half maximum wavelength region of its absorption peak is in a visual region that includes the wavelength regions of the flash light when its intensity is 50% or greater of its maximum but does not include the wavelength region of the exposure light. Comparative Examples 11 to 15 use a charge transport agent in which the half maximum wavelength region of its absorption peak is not in that wavelength region.

Table 4 shows that no image irregularities were produced in Examples 11 to 13, and that image fogging and image density do not worsen after repeated image formation.

On the other hand, Comparative Examples 11 to 15 produced severe image irregularities, and image fogging and image density worsened due to repeated image formation. This is thought to be due to the residual charge in the photosensitive layer and the deterioration of the charge generating agent, which itself is caused by the charge transfer agent not absorbing light leaked from the halogen lamp.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An electrophotographic photoreceptor employed in an image forming device having a flash fixing means for fixing a toner image to a recording medium by generating a flash light and exposing the toner image thereto, the electrophotographic photoreceptor comprising:

a photosensitive layer disposed on top of a support substrate, the photosensitive layer comprising a photoconductive layer that contains a charge generating agent and a charge transport agent therein;

wherein when an intensity of the flash light is 50% or greater of its maximum, a half maximum wavelength region of an absorption peak of the charge transport agent is in a visual region which does not include a wavelength region of the exposure light.

2. The electrophotographic photoreceptor set forth in claim 1, wherein if the photoconductive layer does not contain a charge generating agent, then the photoconductive layer has an absorbance wavelength that is in a visual region which includes the wavelength region of the flash light when its intensity is 50% or greater of its maximum but does not include the wavelength region of the exposure light, and has a light absorbance of 1 unit or greater per one micron of thickness thereof at that absorbance wavelength.

3. The electrophotographic photoreceptor set forth in claim 1, wherein the photosensitive layer is a single layer type.

4. The electrophotographic photoreceptor set forth in claim 1, wherein if the photoconductive layer does not contain a charge generating agent, then the photoconductive layer will absorb 0.01 units or less of light per one micron thereof in the wavelength region of the exposure light.

5. An image forming device, comprising:

the electrophotographic photoreceptor set forth in claim 1;

a drive means that drives the photoreceptor in a fixed direction;

a flash fixing means that fixes a toner image to a recording medium by generating a flash light and exposing the toner image thereto; and an image forming unit is disposed along the direction in which the photoreceptor is driven and which is comprised of an exposure light means.

6. The image forming device set forth in claim 5, wherein the wavelength region of the flash light generated in the image forming device of the present invention is in the 400 nm to 586 nm region, the 817 nm to 844 nm region, and the 882 to 900 nm region when the flash light is at 50% or greater of its maximum intensity;

the wavelength region of the exposure light generated by the exposure means is in the 760 nm to 800 nm region;

the charge generating agent is a metal-containing or a metal-free phthalocyanine compound; and the charge transport agent is selected from the group consisting of the following general formulas (1) to (6):

(1)

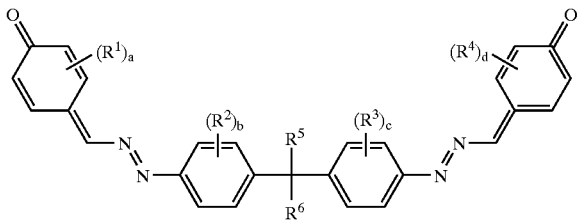

wherein $R^1$ to $R^6$ are independently selected from the group consisting of hydrogen, halogen, alkyl, halogen substituted alkyl, alkoxy, halogen substituted alkoxy, aryl, nitro and cyano, and a to d are integers from 1 to 4;

(2)

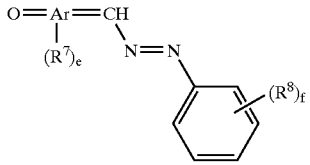

wherein Ar is an aromatic hydrocarbon or a fused polycyclic hydrocarbon, $R^7$ to $R^8$ are independently selected from the group consisting of hydrogen, halogen, alkyl, halogen substituted alkyl, alkoxy, halogen substituted alkoxy, aryl, nitro and cyano, e is an integer from 1 to 4, and f is an integer from 1 to 5;

(3)

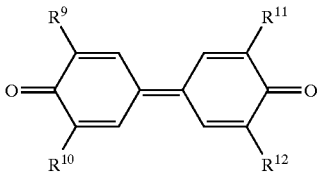

wherein $R^9$ to $R^{12}$ are independently selected from the group consisting of hydrogen, halogen, alkyl, halogen substituted alkyl, alkoxy, halogen substituted alkoxy, aryl, nitro and cyano;

(4)

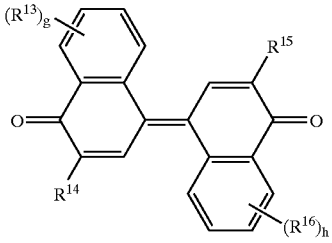

wherein $R^{13}$ to $R^{16}$ are independently selected from the group consisting of hydrogen, halogen, alkyl, halogen substituted alkyl, alkoxy, halogen substituted alkoxy, aryl, nitro and cyano, and g and h are integers from 1 to 4;

(5)

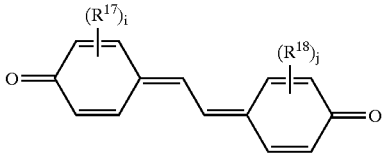

wherein $R^{17}$ to $R^{18}$ are independently selected from the group consisting of hydrogen, halogen, alkyl, halogen substituted alkyl, alkoxy, halogen substituted alkoxy, aryl, nitro and cyano, and i and j are integers from 1 to 4; and (6)

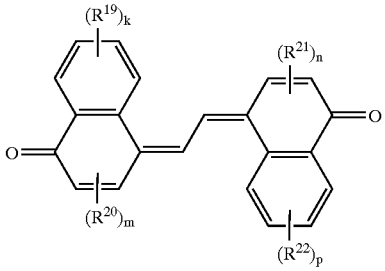

wherein $R^{19}$ to $R^{22}$ are independently selected from the group consisting of hydrogen, halogen, alkyl, halogen substituted alkyl, alkoxy, halogen substituted alkoxy, aryl, nitro and cyano, k and p are integers from 1 to 4, and m and n are integers from 1 to 2.

7. An electrophotographic photoreceptor employed in an image forming device having a flash fixing means for fixing a toner image to a recording medium by generating a flash light and exposing the toner image thereto, the electrophotographic photoreceptor comprising:

a photosensitive layer disposed on top of a support substrate, the photosensitive layer comprising a charge generating layer that contains a charge generating agent, and a charge transport layer that contains a charge transport agent and which is disposed on top of the charge generating layer;

wherein when an intensity of the flash light is 50% or greater of its maximum, a half maximum wavelength region of an absorption peak of the charge transport agent is in a visual region which does not include a wavelength region of the exposure light.

8. The electrophotographic photoreceptor set forth in claim 7, wherein the charge transport layer has an absorbance wavelength that is in a visual region which includes the wavelength region of the flash light when it is at 50% or greater of its maximum intensity but does not include the wavelength region of the exposure light, and has a light absorbance of 1 unit or greater at that absorbance wavelength.

9. The electrophotographic photoreceptor set forth in claim 7, wherein the charge transport layer will absorb 0.1 units or less of light in the wavelength region of the exposure light.

10. An image forming device, comprising:

the electrophotographic photoreceptor set forth in claim 7;

a drive means that drives the photoreceptor in a fixed direction;

a flash fixing means that fixes a toner image to a recording medium by generating a flash light and exposing the toner image thereto; and an image forming unit is disposed along the direction in which the photoreceptor is driven and which is comprised of an exposure light means.

11. The image forming device set forth in claim 10, wherein the wavelength region of the flash light generated in the image forming device of the present invention is in the 400 nm to 586 nm region, the 817 nm to 844 nm region, and the 882 to 900 nm region when the flash light is at 50% or greater of its maximum intensity;

the wavelength region of the exposure light generated by the exposure means is in the 760 nm to 800 nm region;

the charge generating agent is a metal-containing or a metal-free phthalocyanine compound; and the charge transport agent is selected from the group consisting of the following general formulas (1) to (6):

(1)

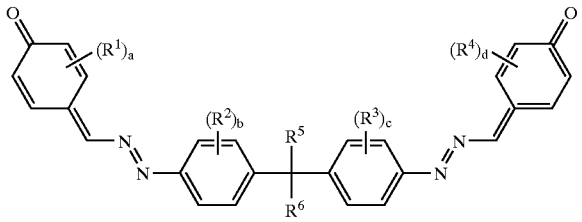

wherein $R^1$ to $R^6$ are independently selected from the group consisting of hydrogen, halogen, alkyl, halogen substituted alkyl, alkoxy, halogen substituted alkoxy, aryl, nitro and cyano, and a to d are integers from 1 to 4;

(2)

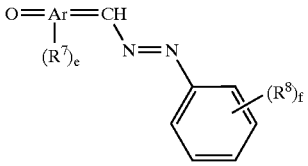

wherein Ar is an aromatic hydrocarbon or a fused polycyclic hydrocarbon, $R^7$ to $R^8$ are independently selected from the group consisting of hydrogen, halogen, alkyl, halogen substituted alkyl, alkoxy, halogen substituted alkoxy, aryl, nitro and cyano, e is an integer from 1 to 4, and f is an integer from 1 to 5;

(3)

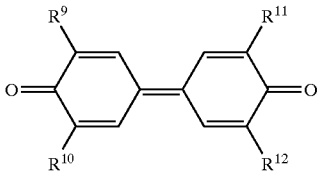

wherein $R^9$ to $R^{12}$ are independently selected from the group consisting of hydrogen, halogen, alkyl, halogen substituted alkyl, alkoxy, halogen substituted alkoxy, aryl, nitro and cyano;

(4)

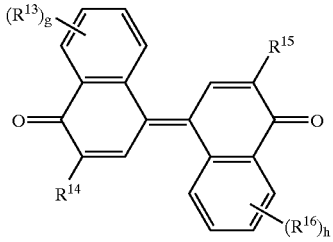

wherein $R^{13}$ to $R^{16}$ are independently selected from the group consisting of hydrogen, halogen, alkyl, halogen substituted alkyl, alkoxy, halogen substituted alkoxy, aryl, nitro and cyano, and g and h are integers from 1 to 4;

(5)

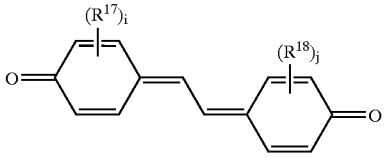

wherein $R^{17}$to $R^{18}$ are independently selected from the group consisting of hydrogen, halogen, alkyl, halogen substituted alkyl, alkoxy, halogen substituted alkoxy, aryl, nitro and cyano, and i and j are integers from 1 to 4; and (6)

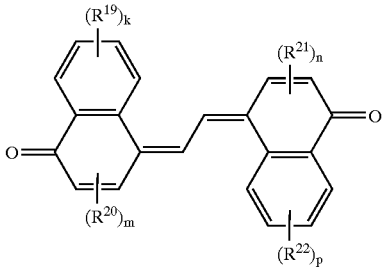

wherein $R^{19}$ to $R^{22}$ are independently selected from the group consisting of hydrogen, halogen, alkyl, halogen substituted alkyl, alkoxy, halogen substituted alkoxy, aryl, nitro and cyano, k and p are integers from 1 to 4, and m and n are integers from 1 to 2.

* * * * *